US009713747B2

(12) United States Patent
Sajima et al.

(10) Patent No.: US 9,713,747 B2
(45) Date of Patent: Jul. 25, 2017

(54) GOLF BALL

(71) Applicant: DUNLOP SPORTS CO. LTD., Kobe-shi, Hyogo (JP)

(72) Inventors: Takahiro Sajima, Kobe (JP); Hyoungchol Kim, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 161 days.

(21) Appl. No.: 14/444,300

(22) Filed: Jul. 28, 2014

(65) Prior Publication Data

US 2015/0031477 A1 Jan. 29, 2015

(30) Foreign Application Priority Data

Jul. 29, 2013 (JP) ..... 2013-156407

(51) Int. Cl.
*A63B 37/00* (2006.01)

(52) U.S. Cl.
CPC ..... *A63B 37/0021* (2013.01); *A63B 37/0004* (2013.01); *A63B 37/0007* (2013.01); *A63B 37/0018* (2013.01); *A63B 37/0006* (2013.01); *A63B 37/0012* (2013.01)

(58) Field of Classification Search
CPC ..... A63B 37/0007; A63B 37/0021
See application file for complete search history.

(56) References Cited

U.S. PATENT DOCUMENTS

2003/0220158 A1 11/2003 Aoyama
2005/0101412 A1 5/2005 Sajima et al.
2007/0298908 A1 12/2007 Sajima
2011/0028245 A1 2/2011 Nakagawa et al.
2011/0034274 A1* 2/2011 Sajima ..... A63B 37/0006 473/384
2013/0005509 A1* 1/2013 Nakamura ..... A63B 37/0004 473/383
2013/0005510 A1* 1/2013 Kim ..... G06F 17/50 473/384
2014/0200099 A1* 7/2014 Aoyama ..... A63B 37/0007 473/383

FOREIGN PATENT DOCUMENTS

EP 2 783 731 A2 10/2014
JP 2008-137692 A 6/2005
JP 2008-389 A 1/2008
JP 2013-9776 A 1/2013

* cited by examiner

*Primary Examiner* — John E Simms, Jr.
(74) *Attorney, Agent, or Firm* — Birch, Stewart, Kolasch & Birch, LLP

(57) ABSTRACT

A golf ball has a large number of dimples on a surface thereof. The golf ball meets the following mathematical formula (I):

$$Su \leq 9.0 * So - 6.04 \quad \text{(I)},$$

Where: So represents a ratio of a sum of spherical surface areas of all the dimples to a surface area of a phantom sphere of the golf ball; and Su represents a standard deviation ($mm^2$) of the spherical surface areas of all the dimples. Preferably, the ratio So is equal to or greater than 0.780. Preferably, the standard deviation Su is equal to or less than 2.150 $mm^2$. Preferably, a number of the dimples is equal to or greater than 300 but equal to or less than 390. Preferably, an average Sa of the spherical surface areas s of all the dimples is equal to or greater than 14.00 $mm^2$.

12 Claims, 52 Drawing Sheets

D D D

A A A A A A A B B B B B B B A A A A A A A

B A B
A A A

A A A A A A A B B B B B B B B A A A A A A A A A A A A A A A A A A A A B B B B B B A A A A A A A A A A A A A A A A A A C A A A A A A A A A A A A A A A A A A A

GOLF BALL

This application claims priority on Patent Application No. 2013-156407 filed in JAPAN on Jul. 29, 2013. The entire contents of this Japanese Patent Application are hereby incorporated by reference.

BACKGROUND OF THE INVENTION

Field of the Invention

The present invention relates to golf balls. Specifically, the present invention relates to improvement of dimples of golf balls.

Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

US2005/0101412 (JP2005-137692) discloses a golf ball in which the standard deviation of the sizes of dimples is low. The standard deviation of the sizes of the dimples influences the flight performance of the golf ball. It is known to one skilled in the art that a golf ball in which the standard deviation is low has excellent flight performance.

US2007/0298908 (JP2008-389) discloses a golf ball in which the density of dimples is high. The density of the dimples influences the flight performance of the golf ball. It is known to one skilled in the art that a golf ball in which the density is high has excellent flight performance.

When small dimples are arranged in narrow zones each surrounded by a plurality of dimples, a dimple pattern that provides a high density is obtained. However, the small dimples are unlikely to contribute to turbulization. In a golf ball having such small dimples, the standard deviation of the sizes of the dimples is high. Increasing the density of the dimples and decreasing the standard deviation of the sizes of the dimples are contradictory to each other.

The greatest interest to golf players concerning golf balls is flight distance. In light of flight performance, there is room for further improvement in a dimple pattern. An object of the present invention is to provide a golf ball having excellent flight performance by achieving, at the same time, increasing the density of dimples and decreasing the standard deviation of the spherical surface areas of the dimples, which are contradictory to each other.

SUMMARY OF THE INVENTION

A golf ball according to the present invention has a large number of dimples on a surface thereof. A ratio So of a sum of spherical surface areas of all the dimples to a surface area of a phantom sphere of the golf ball is equal to or greater than 0.780. The golf ball meets the following mathematical formula (I):

$$Su \leq 9.0 * So - 6.04 \quad \text{(I)},$$

where Su represents a standard deviation ($mm^2$) of the spherical surface areas of all the dimples.

Preferably, the ratio So is equal to or greater than 0.840. Preferably, the standard deviation Su is equal to or less than 2.150 $mm^2$. Preferably, the standard deviation Su is equal to or less than 1.946 $mm^2$.

Preferably, a number of the dimples is equal to or greater than 300 but equal to or less than 390. Preferably, an average Sa of the spherical surface areas of all the dimples is equal to or greater than 14.00 $mm^2$.

The golf ball may have dimples whose contours are non-circular. Preferably, each dimple has a contour shape different from those of any other dimples.

Preferably, the golf ball meets the following mathematical formula (II):

$$Su \leq 9.0 * So - 6.25 \quad \text{(II)}.$$

Preferably, the golf ball meets the following mathematical formula (III):

$$Su \leq 9.0 * So - 6.46 \quad \text{(III)}.$$

Preferably, the golf ball meets the following mathematical formula (IV):

$$Su \leq 9.0 * So - 6.67 \quad \text{(IV)}.$$

DESCRIPTION OF THE PREFERRED EMBODIMENTS

The following will describe in detail the present invention, based on preferred embodiments with reference to the accompanying drawings.

Figure 1:
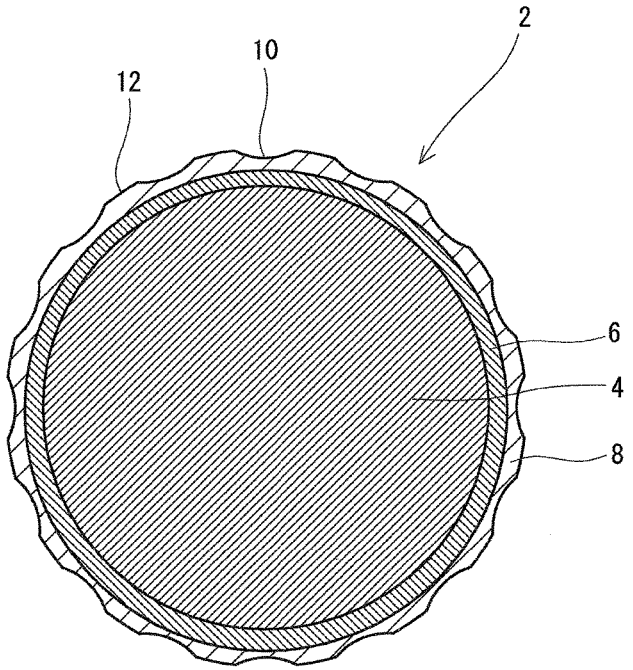
FIG. 1 is a cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. On the surface of the cover 8, a large number of dimples 10 are formed.

Of the surface of the golf ball 2, a part other than the dimples 10 is a land 12. The golf ball 2 includes a paint layer and a mark layer on the external side of the cover 8 although these layers are not shown in the drawing.

The golf ball 2 has a diameter of preferably 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and high-cis polybutadienes are particularly preferred.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, a dispersant, a carboxylic acid, a carboxylate, and the like. The rubber composition may include synthetic resin powder or crosslinked rubber powder.

The core 4 has a diameter of preferably 30.0 mm or greater and particularly preferably 38.0 mm or greater. The diameter of core 4 is preferably equal to or less than 42.0 mm and particularly preferably equal to or less than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably 0.2 mm or greater and particularly preferably 0.3 mm or greater. The thickness of the mid layer 6 is preferably equal to or less than 2.5 mm and particularly preferably equal to or less than 2.2 mm. The mid layer 6 has a specific gravity of preferably 0.90 or greater and particularly preferably 0.95 or greater. The specific gravity of the mid layer 6 is preferably equal to or less than 1.10 and particularly preferably equal to or less than 1.05. The mid layer 6 may have two or more layers.

The cover 8 is formed from a resin composition. A preferable base polymer of the resin composition is a polyurethane. The resin composition may include a thermoplastic polyurethane or may include a thermosetting polyurethane. In light of productivity, the thermoplastic polyurethane is preferred. The thermoplastic polyurethane includes a polyurethane component as a hard segment, and a polyester component or a polyether component as a soft segment.

Examples of a curing agent for the polyurethane component include alicyclic diisocyanates, aromatic diisocyanates, and aliphatic diisocyanates. Alicyclic diisocyanates are particularly preferred. Since an alicyclic diisocyanate does not have any double bond in the main chain, the alicyclic diisocyanate suppresses yellowing of the cover 8. Examples of alicyclic diisocyanates include 4,4'-dicyclohexylmethane diisocyanate ($H_{12}MDI$), 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferred.

Instead of a polyurethane, the resin composition of the cover 8 may include another polymer. Examples of the other polymer include ionomer resins, polystyrenes, polyamides, polyesters, and polyolefins. The resin composition may include two or more polymers.

The resin composition of the cover 8 may include a coloring agent such as titanium dioxide, a filler such as barium sulfate, a dispersant, an antioxidant, an ultraviolet absorber, a light stabilizer, a fluorescent material, a fluorescent brightener, and the like.

The cover 8 has a thickness of preferably 0.2 mm or greater and particularly preferably 0.3 mm or greater. The thickness of the cover 8 is preferably equal to or less than 2.5 mm and particularly preferably equal to or less than 2.2 mm. The cover 8 has a specific gravity of preferably 0.90 or greater and particularly preferably 0.95 or greater. The specific gravity of the cover 8 is preferably equal to or less than 1.10 and particularly preferably equal to or less than 1.05. The cover 8 may have two or more layers.

The golf ball 2 may include a reinforcing layer between the mid layer 6 and the cover 8. The reinforcing layer firmly adheres to the mid layer 6 and also to the cover 8. The reinforcing layer suppresses separation of the cover 8 from the mid layer 6. Examples of the base polymer of the reinforcing layer include two-component curing type epoxy resins and two-component curing type urethane resins.

As shown in FIGS. 2 to 7, the contour of each dimple 10 is circular. The golf ball 2 has dimples A each having a diameter of 4.50 mm; dimples B each having a diameter of 4.40 mm; dimples C each having a diameter of 4.30 mm; and dimples D each having a diameter of 4.15 mm. The number of types of the dimples 10 is four.

The number of the dimples A is 28; the number of the dimples B is 122; the number of the dimples C is 100; and the number of the dimples D is 74. The total number N of the dimples 10 is 324. The average of the diameters of all the dimples 10 is 4.321 mm.

The spherical surface area s of each dimple 10 is the area of a zone surrounded by the contour line of the dimple 10, of the surface of a phantom sphere of the golf ball 2. In the golf ball 2 shown in FIGS. 2 to 7, the spherical surface area s of each dimple A is 15.95 $mm^2$; the spherical surface area s of each dimple B is 15.25 $mm^2$; the spherical surface area s of each dimple C is 14.56 $mm^2$; and the spherical surface area s of each dimple D is 13.56 $mm^2$. The average Sa of the spherical surface areas s of all the dimples 10 is 14.71 $mm^2$.

The ratio of the sum of the spherical surface areas s of all the dimples 10 to the surface area of the phantom sphere is referred to as a spherical surface occupation ratio So. In light of turbulization, the spherical surface occupation ratio So is preferably equal to or greater than 0.780, more preferably equal to or greater than 0.800, and particularly preferably equal to or greater than 0.840. The spherical surface occupation ratio So is preferably equal to or less than 0.950. In the golf ball 2 shown in FIGS. 2 to 7, the sum of the spherical surface areas s is 4765.8 $mm^2$. The surface area of the phantom sphere of the golf ball 2 is 5728.0 $mm^2$, and thus the spherical surface occupation ratio So is 0.832.

The standard deviation Su of the spherical surface areas s ($mm^2$) of all the dimples 10 is preferably equal to or less than 2.150. In the golf ball 2 in which the standard deviation Su is equal to or less than 2.150, turbulization is prompted. In this respect, the standard deviation Su is more preferably equal to or less than 1.950 and particularly preferably equal to or less than 1.650. The standard deviation Su may be zero. The standard deviation Su of the golf ball 2 shown in FIGS. 2 to 7 is calculated by the following mathematical formula.

$$Su=(((15.95-14.71)^2*28+(15.25-14.71)^2*122+(14.56-14.71)^2*100+(13.56-14.71)^2*74)/324)^{1/2}$$

The standard deviation Su of the golf ball 2 is 0.742.

Figure 8:
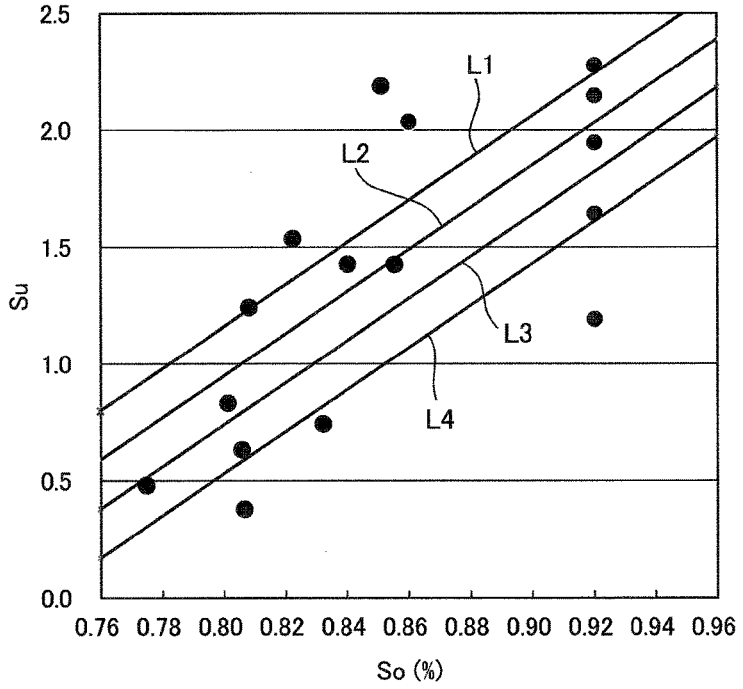
FIG. 8 is a graph showing the relationship between an occupation ratio So and a standard deviation Su.

In the graph of FIG. 8, the horizontal axis indicates the spherical surface occupation ratio So, and the vertical axis indicates the standard deviation Su. A straight line indicated by a reference sign L1 in the graph of FIG. 8 is represented by the following mathematical formula.

$$Su=9.0*So-6.04$$

According to the finding by the inventor of the present invention, the golf ball 2 whose coordinate (So,Su) is on or below the straight line L1 has excellent flight performance. In other words, the golf ball 2 that meets the following mathematical formula (I) has excellent flight performance. The reason is inferred to be that turbulization is prompted.

$$Su\leq 9.0*So-6.04 \quad \text{(I)}$$

A straight line indicated by a reference sign L2 in the graph of FIG. 8 is represented by the following mathematical formula.

$$Su=9.0*So-6.25$$

According to the finding by the inventor of the present invention, the golf ball 2 whose coordinate (So,Su) is on or below the straight line L2 has further excellent flight performance. In other words, the golf ball 2 that meets the following mathematical formula (II) has excellent flight performance. The reason is inferred to be that turbulization is prompted.

$$Su\leq 9.0*So-6.25 \quad \text{(II)}$$

A straight line indicated by a reference sign L3 in the graph of FIG. 8 is represented by the following mathematical formula.

$$Su=9.0*So-6.46$$

According to the finding by the inventor of the present invention, the golf ball 2 whose coordinate (So,Su) is on or below the straight line L3 has particularly excellent flight performance. In other words, the golf ball 2 that meets the following mathematical formula (III) has excellent flight performance. The reason is inferred to be that turbulization is prompted.

$$Su\leq 9.0*So-6.46 \quad \text{(III)}$$

A straight line indicated by a reference sign L4 in the graph of FIG. 8 is represented by the following mathematical formula.

$$Su=9.0*So-6.67$$

According to the finding by the inventor of the present invention, the golf ball 2 whose coordinate (So,Su) is on or below the straight line L4 has particularly excellent flight performance. In other words, the golf ball 2 that meets the following mathematical formula (IV) has excellent flight performance. The reason is inferred to be that turbulization is prompted.

$$Su \leq 9.0*So-6.67 \quad \text{(IV)}$$

When arranging the dimples 10, in many cases, a designer initially designs an arrangement of basic dimples 10 and then arranges small dimples 10 in narrow zones each surrounded by a plurality of the dimples 10, in order to further increase a spherical surface occupation ratio. However, the small dimples 10 contribute to the effect of increasing the spherical surface occupation ratio but impair the effect of decreasing the standard deviation. The arrangement of the small dimples 10 does not correspond to the purport of the present invention. In designing a pattern of dimples 10 according to the present embodiment, the designer focuses on the center-to-center distance between adjacent dimples 10 from the stage of designing the basic dimples 10. The designer designs the pattern with due consideration to making the center-to-center distance between the adjacent dimples 10 as small as possible. Therefore, even when no small dimple 10 is arranged, the spherical surface occupation ratio can be increased.

The average Sa of the spherical surface areas s of all the dimples 10 is preferably equal to or greater than 14.00 $mm^2$, more preferably equal to or greater than 15.00 $mm^2$, and particularly preferably equal to or greater than 15.50 $mm^2$. The average Sa is preferably equal to or less than 20.00 $mm^2$.

Figure 9:
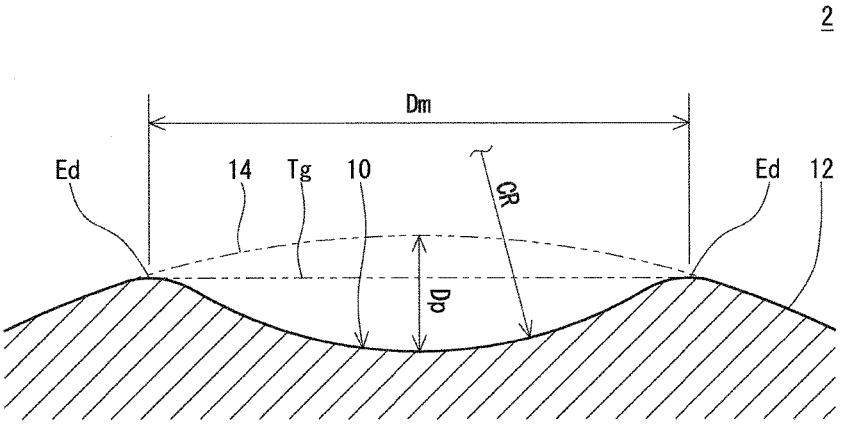
FIG. 9 is a partially enlarged cross-sectional view of the golf ball in FIG. 1.

FIG. 9 shows a cross section along a plane passing through the center of the dimple 10 and the center of the golf ball 2. In FIG. 9, the top-to-bottom direction is the depth direction of the dimple 10. In FIG. 9, what is indicated by a chain double-dashed line is a phantom sphere 14. The surface of the phantom sphere 14 is the surface of the golf ball 2 when it is postulated that no dimple 10 exists. The dimple 10 is recessed from the surface of the phantom sphere 14. The land 12 coincides with the surface of the phantom sphere 14. In the present embodiment, the cross-sectional shape of each dimple 10 is substantially a circular arc.

In FIG. 9, what is indicated by a double ended arrow Dm is the diameter of the dimple 10. The diameter Dm is the distance between two tangent points Ed appearing on a tangent line Tg that is drawn tangent to the far opposite ends of the dimple 10. Each tangent point Ed is also the edge of the dimple 10. The edge Ed defines the contour of the dimple 10. In FIG. 9, what is indicated by a double ended arrow Dp is the depth of the dimple 10. The depth Dp is the distance between the deepest part of the dimple 10 and the phantom sphere 14.

The diameter Dm of each dimple 10 is preferably equal to or greater than 2.0 mm but equal to or less than 6.0 mm. The dimple 10 having a diameter Dm of 2.0 mm or greater contributes to turbulization. In this respect, the diameter Dm is more preferably equal to or greater than 2.2 mm and particularly preferably equal to or greater than 2.4 mm. The dimple 10 having a diameter Dm of 6.0 mm or less does not impair a fundamental feature of the golf ball 2 being substantially a sphere. In this respect, the diameter Dm is more preferably equal to or less than 5.8 mm and particularly preferably equal to or less than 5.6 mm.

In light of suppression of rising of the golf ball 2 during flight, the depth Dp of each dimple 10 is preferably equal to or greater than 0.10 mm, more preferably equal to or greater than 0.13 mm, and particularly preferably equal to or greater than 0.15 mm. In light of suppression of dropping of the golf ball 2 during flight, the depth Dp is preferably equal to or less than 0.65 mm, more preferably equal to or less than 0.60 mm, and particularly preferably equal to or less than 0.55 mm.

In FIG. 9, what is indicated by an arrow CR is the curvature radius of the dimple 10. The curvature radius CR is calculated by the following mathematical formula.

$$CR=(Dp^2Dm^2/4)/(2*Dp)$$

Also in the case of a dimple 10 whose cross-sectional shape is not a circular arc, the curvature radius CR is approximately calculated on the basis of the above mathematical formula.

From the standpoint that a sufficient spherical surface occupation ratio So is obtained, the total number N of the dimples 10 is preferably equal to or greater than 300, more preferably equal to or greater than 310, and particularly preferably equal to or greater than 320. From the standpoint that each dimple 10 can contribute to turbulization, the total number N is preferably equal to or less than 390, more preferably equal to or less than 380, and particularly preferably equal to or less than 370.

In the present invention, the "volume of the dimple" means the volume of a portion surrounded by the phantom sphere 14 and the surface of the dimple 10. In light of suppression of rising of the golf ball 2 during flight, the total volume of all the dimples 10 is preferably equal to or greater than 450 $mm^3$, more preferably equal to or greater than 480 $mm^3$, and particularly preferably equal to or greater than 500 $mm^3$. In light of suppression of dropping of the golf ball 2 during flight, the total volume is preferably equal to or less than 750 $mm^3$, more preferably equal to or less than 730 $mm^3$, and particularly preferably equal to or less than 710 $mm^3$.

Figure 10:
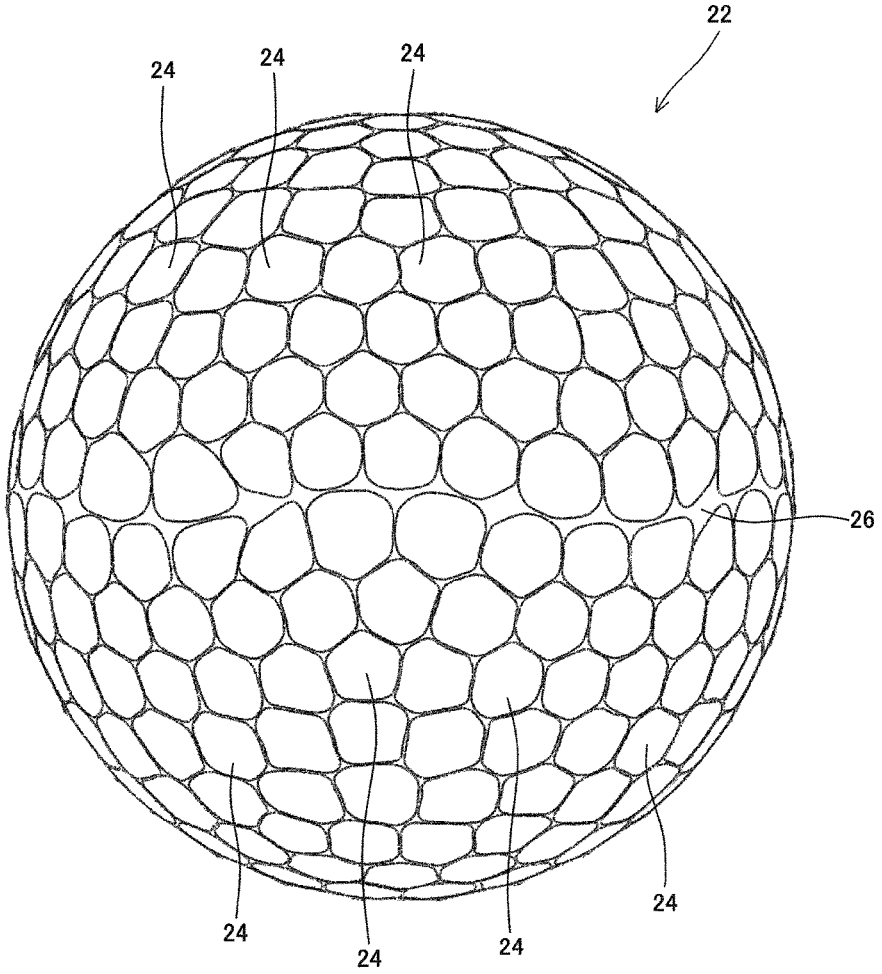
FIG. 10 is a front view of a golf ball according to another embodiment of the present invention.
Figure 11:
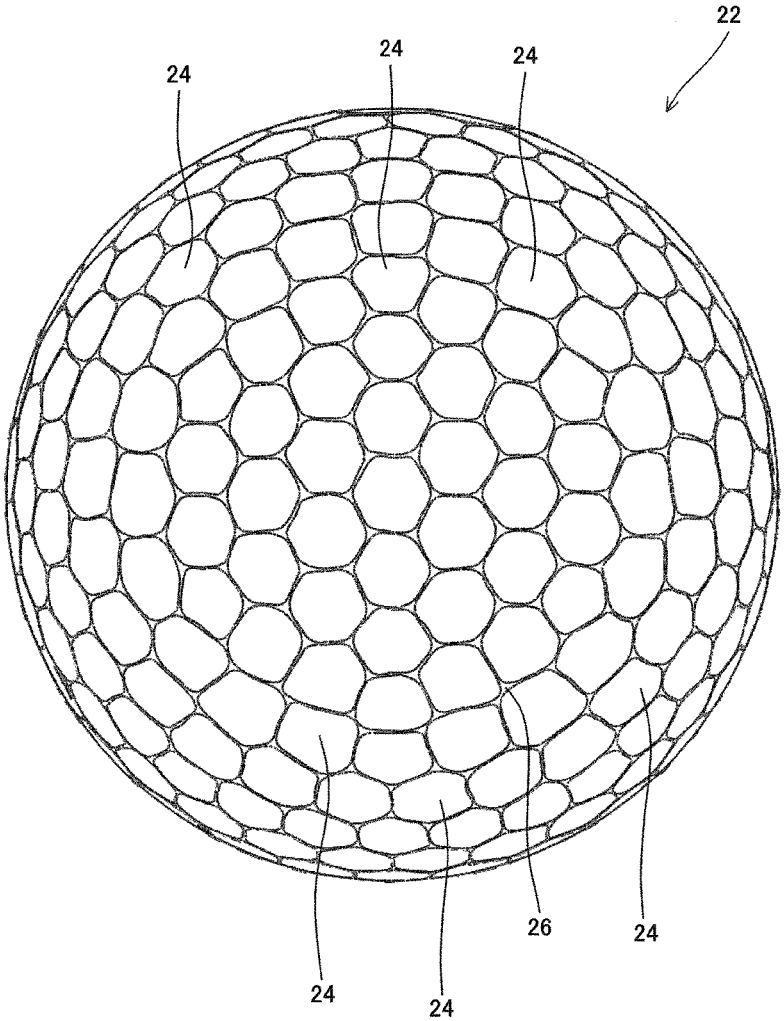
FIG. 11 is a plan view of the golf ball in FIG. 10.

FIG. 10 is a front view of a golf ball 22 according to another embodiment of the present invention. FIG. 11 is a plan view of the golf ball 22 in FIG. 10. As is obvious from FIGS. 10 and 11, the golf ball 22 has a large number of non-circular dimples 24. By these dimples 24 and a land 26, a rugged pattern is formed on the surface of the golf ball 22.

In a process for designing the rugged pattern, a Voronoi tessellation is used. In the designing process, a large number of generating points are arranged on the surface of the phantom sphere 14 (see FIG. 9). A large number of regions are assumed on the surface of the phantom sphere 14 based on the generating points by the Voronoi tessellation. In the present specification, these regions are referred to as "Voronoi regions". The dimples 24 and the land 26 are assigned based on the contours of these Voronoi regions. A pattern designing process based on a Voronoi tessellation is disclosed in JP2013-9906.

Figure 12:
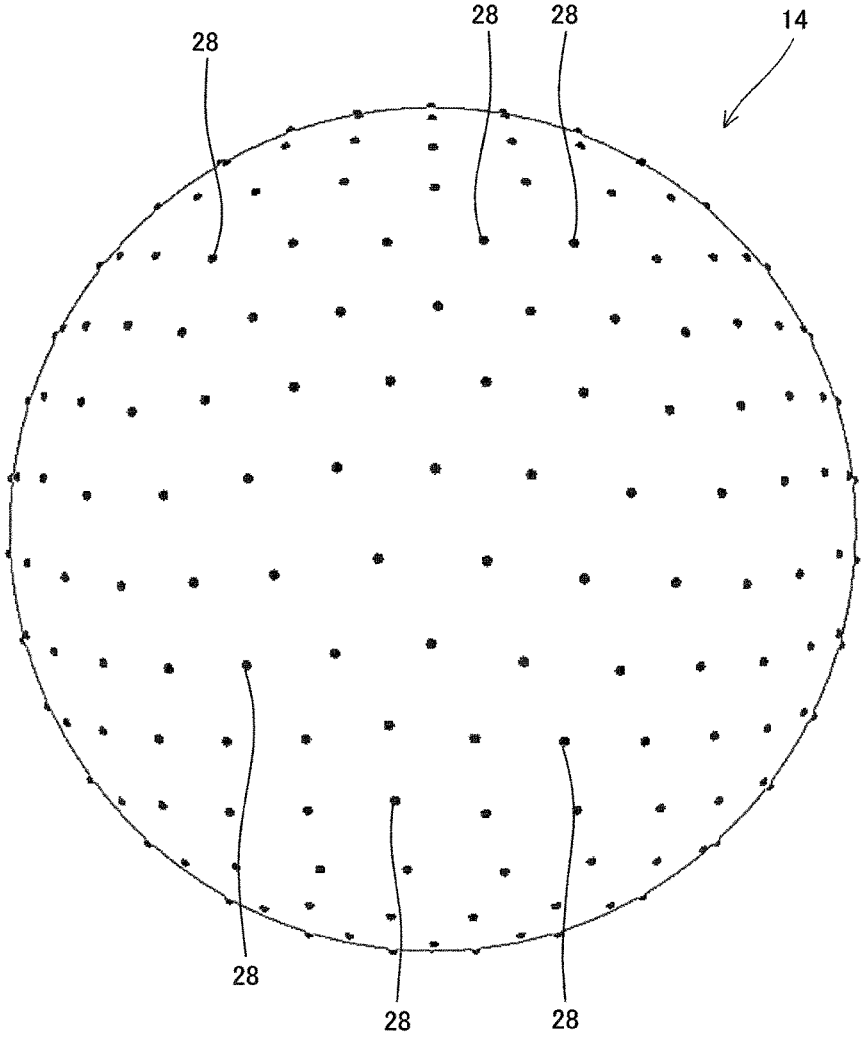
FIG. 12 is a front view of a phantom sphere in which a large number of generating points are assumed on a surface thereof.
Figure 13:
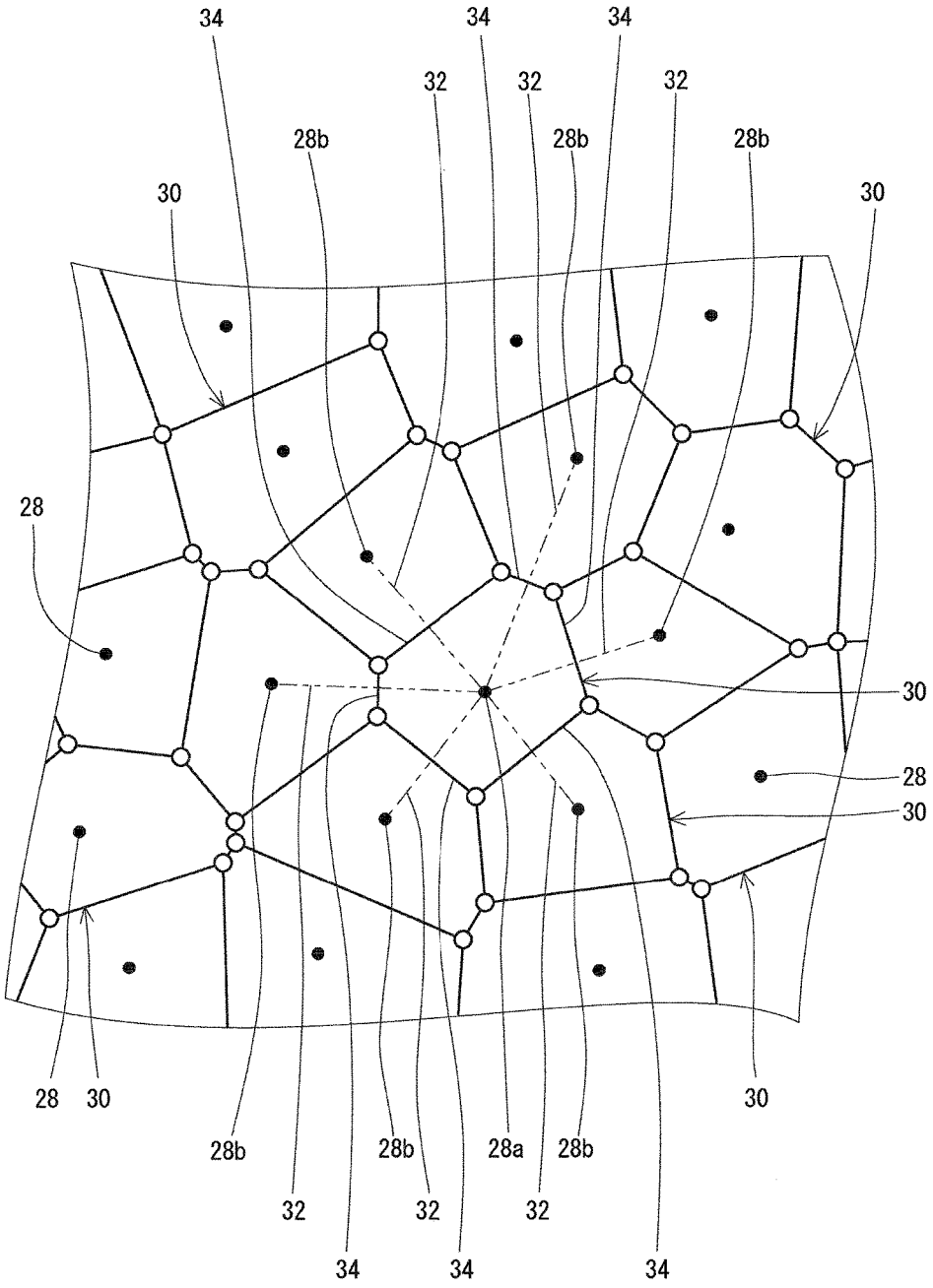
FIG. 13 is an enlarged view showing the generating points in FIG. 12 with Voronoi regions.

The following will describe an example of the pattern designing process based on the Voronoi tessellation in detail. In the designing process, a large number of generating points are assumed on the surface of the phantom sphere 14. FIG. 12 shows these generating points 28. In the present embodiment, the number of the generating points 28 is 344. A large number of Voronoi regions are assumed based on these generating points 28. FIG. 13 shows the Voronoi regions 30. In FIG. 13, a generating point 28*a* is adjacent to six generating points 28*b*. What is indicated by each reference sign 32 is a line segment connecting the generating point 28*a* to the generating point 28*b*. FIG. 13 shows six line segments 32. What is indicated by each reference sign 34 is the perpendicular bisector of the line segment 32. The generating point 28*a* is surrounded by six perpendicular bisectors 34. What is indicated by each outline circle in FIG. 13 is the intersection point between a perpendicular bisector 34 and another perpendicular bisector 34. A point obtained by projecting the intersection point onto the surface of the phantom sphere 14 is a vertex of a spherical polygon (e.g., a spherical hexagon). This projection is performed by light emitted from the center of the phantom sphere 14. The spherical polygon is a Voronoi region 30. The surface of the phantom sphere 14 is divided into a large number of the Voronoi regions 30. The method for the division is referred to as a Voronoi tessellation. In the present embodiment, since the number of the generating points 28 is 344, the number of the Voronoi regions 30 is 344.

Figure 14:
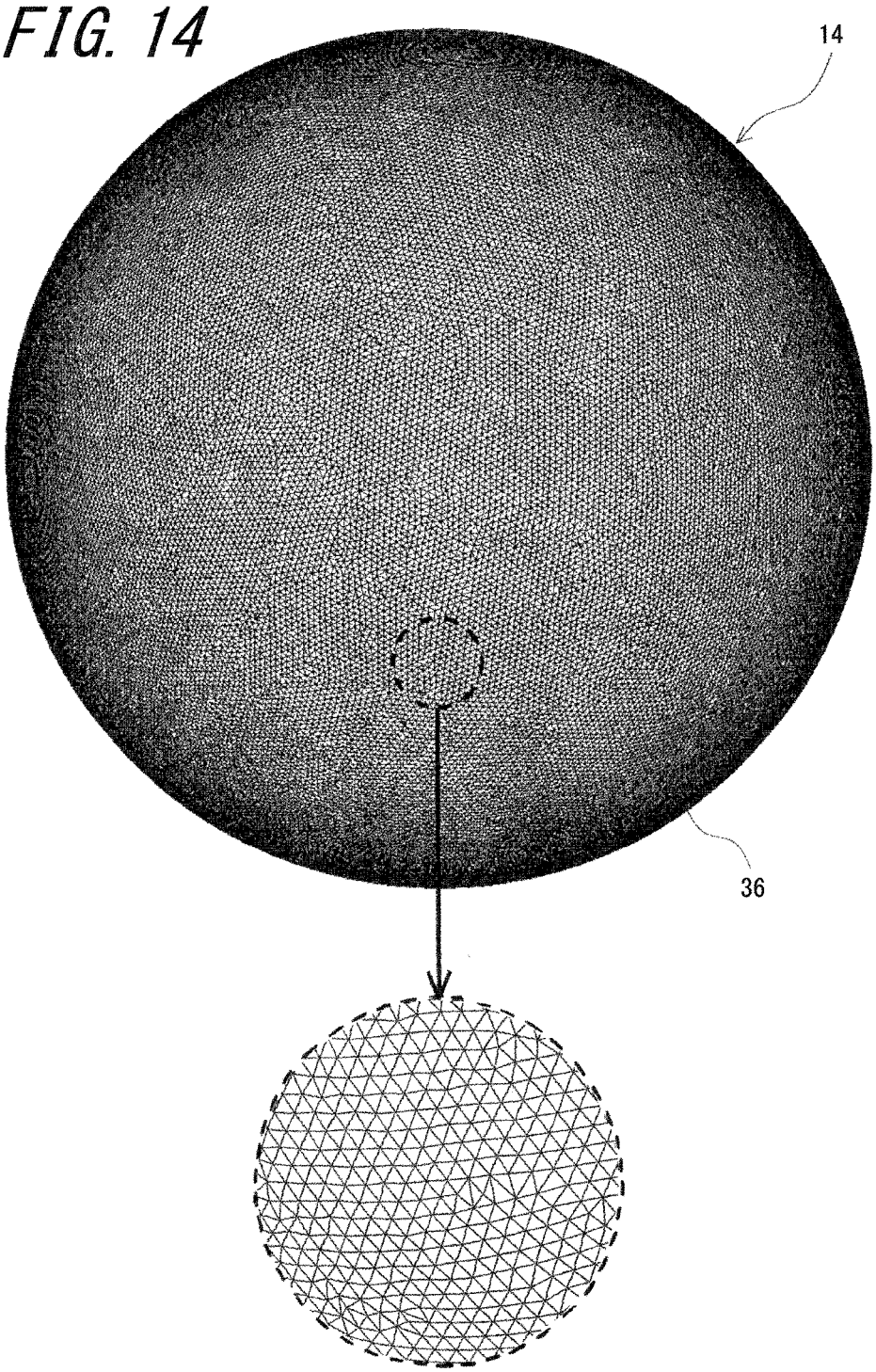
FIG. 14 is a front view of a mesh used in a Voronoi tessellation.

Calculation for defining the contour of each Voronoi region 30 based on the perpendicular bisectors 34 is complicated. The following will describe a method for simply obtaining Voronoi regions 30. In the method, the surface of the phantom sphere 14 is divided into a large number of spherical triangles. This division is performed based on an advancing front method. The advancing front method is disclosed at Pages 195 to 197 of "Daigakuin Johoshorikogaku 3, Keisan Rikigaku (Information Science and Technology for Graduate School 3, Computational Dynamics)" (edited by Koichi ITO, published by Kodansha Ltd.). A mesh 36 shown in FIG. 14 is obtained by this division. The mesh 36 has 314086 triangles and 157045 vertices. Each vertex is defined as a cell (or the center of a cell). The mesh 36 has 157045 cells. The phantom sphere 14 may be divided by other methods. The number of the cells is preferably equal to or greater than 10000 and particularly preferably equal to or greater than 100000.

The distances between each cell in the mesh 36 and all the generating points 28 are calculated. For each cell, distances of which the number is the same as the number of the generating points 28 are calculated. The shortest distance is selected from among these distances. The cell is associated with the generating point 28 on which the shortest distance is based. In other words, the generating point 28 that is closest to the cell is selected. It is noted that calculation of the distances between the cell and the generating points 28 whose distances from the cell are obviously large may be omitted.

Figure 15:
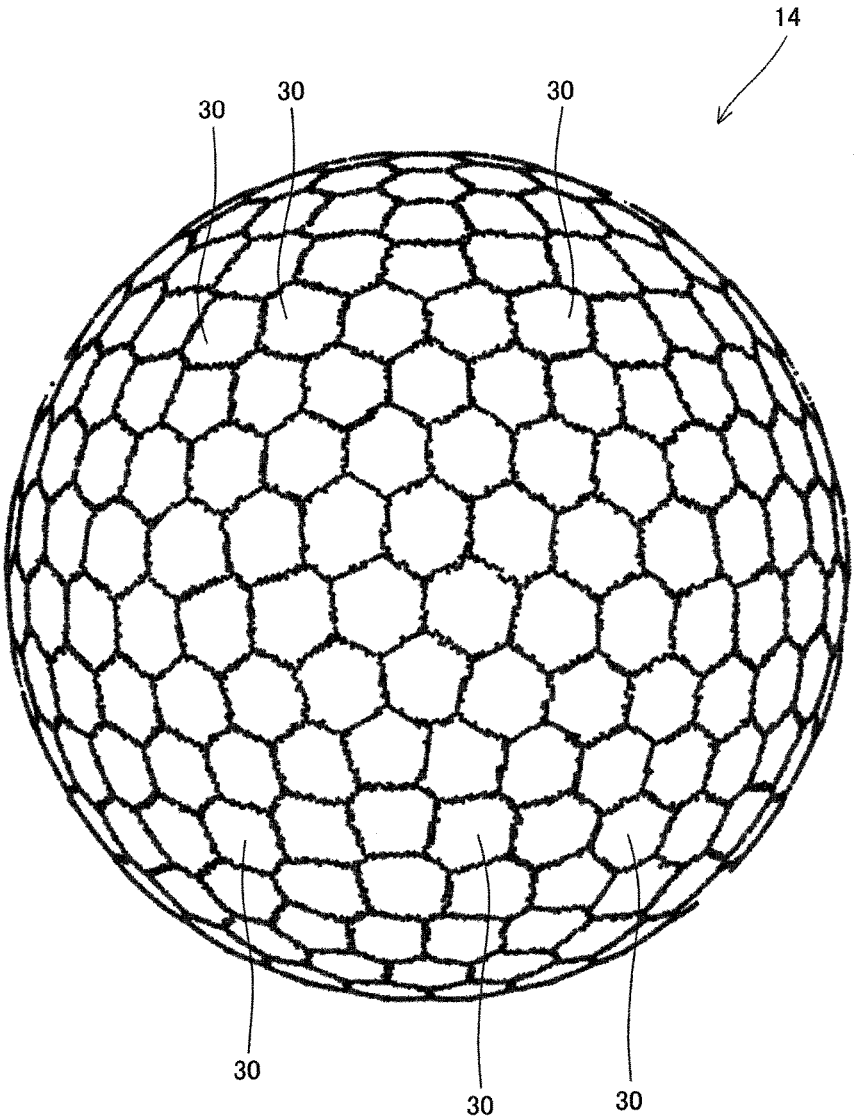
FIG. 15 is a front view of a phantom sphere in which Voronoi regions obtained by a simple method are assumed.
Figure 16:
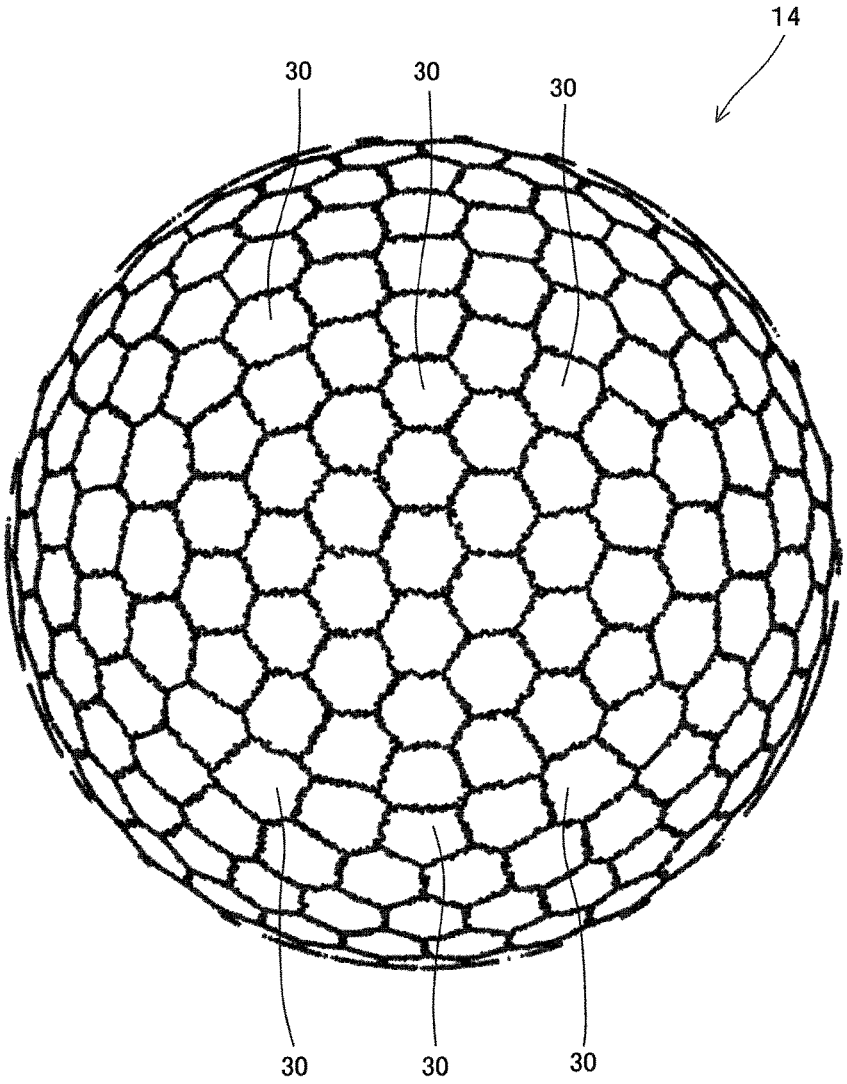
FIG. 16 is a plan view of the phantom sphere in FIG. 15.

For each generating point 28, a set of cells associated with the generating point 28 is assumed. In other words, a set of cells for which this generating point 28 is the closest generating point 28 is assumed. The set is set as a Voronoi region 30. A large number of the Voronoi regions 30 obtained thus are shown in FIGS. 15 and 16. In FIGS. 15 and 16, when another cell adjacent to a certain cell belongs to a Voronoi region 30 different from a Voronoi region 30 to which the certain cell belongs, the certain cell is filled with black.

As is obvious from FIGS. 15 and 16, the contour of each Voronoi region 30 is a zigzag contour. This contour is subjected to smoothing or the like. By the smoothing, a pattern shown in FIGS. 10 and 11 is obtained.

As is obvious from FIGS. 15 and 16, the dimples 24 are not orderly arranged in the golf ball 22. The golf ball 22 has a large number of types of dimples 24 whose contour shapes are different from each other. These dimples 24 achieve a superior dimple effect. The number of the types of the dimples 24 is preferably equal to or greater than 50 and particularly preferably equal to or greater than 100. In the present embodiment, each dimple 24 has a contour shape different from those of any other dimples 24.

The spherical surface occupation ratio So of the golf ball 22 is equal to or greater than 0.780. The golf ball 22 meets the above-described mathematical formulas (I), (II), (III), and (IV).

The center of gravity of a Voronoi region may be calculated, and a Voronoi tessellation may be further performed with the center of gravity as a generating point. The calculation of the center of gravity and the Voronoi tessellation may be repeated. By this repeat, a dimple pattern in which the standard deviation Su of spherical surface areas is very low can be obtained.

EXAMPLES

Example 1

A rubber composition was obtained by kneading 100 parts by weight of a high-cis polybutadiene (trade name "BR-730", manufactured by JSR Corporation), 35 parts by weight of zinc diacrylate, 5 parts by weight of zinc oxide, 5 parts by weight of barium sulfate, 0.5 parts by weight of diphenyl disulfide, 0.9 parts by weight of dicumyl peroxide, and 2.0 parts by weight of zinc octoate. This rubber composition was placed into a mold including upper and lower mold halves each having a hemispherical cavity, and heated at 170° C. for 18 minutes to obtain a core with a diameter of 39.7 mm.

A resin composition was obtained by kneading 50 parts by weight of an ionomer resin (trade name "Surlyn 8945", manufactured by E.I. du Pont de Nemours and Company), 50 parts by weight of another ionomer resin ("Himilan AM7329", manufactured by Du Pont-MITSUI POLYCHEMICALS Co., Ltd.), 4 parts by weight of titanium dioxide, and 0.04 parts by weight of ultramarine blue with a twin-screw kneading extruder. The core was covered with the resin composition by injection molding to form a mid layer with a thickness of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium oxide. The weight ratio of the base material liquid to the curing agent liquid is 1/1. This paint composition was applied to the surface of the mid layer with a spray gun, and kept at 23° C. for 6 hours to obtain a reinforcing layer with a thickness of 10 μm.

A resin composition was obtained by kneading 100 parts by weight of a thermoplastic polyurethane elastomer (trade name "Elastollan XNY85A", manufactured by BASF Japan Ltd.) and 4 parts by weight of titanium dioxide with a twin-screw kneading extruder. Half shells were formed from this resin composition by compression molding. The sphere consisting of the core, the mid layer, and the reinforcing layer was covered with two of these half shells. The sphere and the half shells were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover. A clear paint including a two-component curing type polyurethane as a base material was applied to this cover to obtain a golf ball of Example 1 with a diameter of about 42.7 mm and a weight of about 45.6 g. The amount of compressive deformation that was measured with a YAMADA type compression tester in the case where a load was 98 N to 1274 N was about 2.45 mm. The specifications of the dimples of the golf ball are shown in Table 1 below.

Examples 2 to 10 and Comparative Examples 1 to 6

Golf balls of Examples 2 to 10 and Comparative Examples 1 to 6 were obtained in the same method as Example 1, except the specifications of the dimples were as shown in Tables 1 to 6 below. The golf ball according to Comparative Example 1 has the same dimple pattern as that of the golf ball according to Example 1 described in JP2009-95593. The golf ball according to Comparative Example 2 has the same dimple pattern as that of the golf ball according to Comparative Example 2 described in JP2008-389. The golf ball according to Comparative Example 3 has the same dimple pattern as that of the golf ball according to Comparative Example 2 described in JP2011-30909.

[Flight Distance Test]

A driver with a head made of a titanium alloy (trade name "SRIXON Z-TX", manufactured by DUNLOP SPORTS CO. LTD., shaft hardness: X, loft angle: 8.5°) was attached to a swing machine manufactured by Golf Laboratories, Inc. A golf ball was hit under the conditions of: a head speed of 50 m/sec; a launch angle of about 10°; and a backspin rate of about 2500 rpm, and the distance from the launch point to the stop point was measured. At the test, the weather was almost windless. The average value of data obtained by 20 measurements is shown in Tables 3 to 6 below.

TABLE 1

Specifications of Dimples

| | Type | Number | Diameter Dm (mm) | Depth Dp (mm) | Radius CR (mm) | Area s ($mm^2$) | Volume ($mm^3$) |
|---|---|---|---|---|---|---|---|
| Ex. 1 | A | 16 | 4.600 | 0.259 | 19.66 | 16.67 | 2.157 |
| | B | 30 | 4.500 | 0.254 | 18.82 | 15.95 | 2.021 |
| | C | 30 | 4.400 | 0.249 | 17.99 | 15.25 | 1.892 |
| | D | 150 | 4.300 | 0.244 | 17.19 | 14.56 | 1.770 |
| | E | 30 | 4.200 | 0.239 | 16.40 | 13.89 | 1.654 |
| | F | 66 | 4.100 | 0.234 | 15.63 | 13.23 | 1.544 |
| | G | 10 | 3.800 | 0.220 | 13.44 | 11.36 | 1.247 |
| | H | 12 | 3.400 | 0.203 | 10.77 | 9.09 | 0.922 |
| Ex. 2 | A | 28 | 4.500 | 0.254 | 18.82 | 15.95 | 2.021 |
| | B | 122 | 4.400 | 0.249 | 17.99 | 15.25 | 1.892 |
| | C | 100 | 4.300 | 0.244 | 17.19 | 14.56 | 1.770 |
| | D | 74 | 4.150 | 0.236 | 16.01 | 13.56 | 1.598 |
| Ex. 3 | A | 252 | 4.300 | 0.244 | 17.19 | 14.56 | 1.770 |
| | B | 70 | 4.100 | 0.234 | 15.63 | 13.23 | 1.544 |
| | C | 2 | 3.600 | 0.211 | 12.07 | 10.20 | 1.075 |
| Ex. 4 | A | 252 | 4.300 | 0.244 | 17.19 | 14.56 | 1.770 |
| | B | 70 | 4.050 | 0.231 | 15.26 | 12.91 | 1.491 |
| | C | 2 | 3.200 | 0.195 | 9.55 | 8.05 | 0.786 |
| Ex. 5 | A | 172 | 4.300 | 0.244 | 17.19 | 14.56 | 1.770 |
| | B | 150 | 4.210 | 0.239 | 16.48 | 13.95 | 1.666 |
| | C | 2 | 3.800 | 0.220 | 13.44 | 11.36 | 1.247 |

TABLE 2

Specifications of Dimples

| | Type | Number | Diameter Dm (mm) | Depth Dp (mm) | Radius CR (mm) | Area s ($mm^2$) | Volume ($mm^3$) |
|---|---|---|---|---|---|---|---|
| Comp. Ex. 1 | A | 26 | 4.500 | 0.261 | 17.90 | 15.95 | 2.077 |
| | B | 88 | 4.400 | 0.256 | 17.11 | 15.25 | 1.946 |
| | C | 102 | 4.300 | 0.251 | 16.35 | 14.56 | 1.821 |
| | D | 94 | 4.100 | 0.241 | 14.87 | 13.23 | 1.591 |
| | E | 14 | 3.600 | 0.218 | 11.48 | 10.20 | 1.111 |
| Comp. Ex. 2 | A | 60 | 4.100 | 0.244 | 14.56 | 13.23 | 1.610 |
| | B | 84 | 4.000 | 0.238 | 13.96 | 12.59 | 1.497 |
| | C | 216 | 3.900 | 0.230 | 13.55 | 11.97 | 1.377 |
| Comp. Ex. 3 | A | 40 | 4.650 | 0.273 | 18.59 | 17.03 | 2.321 |
| | B | 70 | 4.550 | 0.268 | 17.80 | 16.31 | 2.178 |
| | C | 40 | 4.450 | 0.262 | 17.03 | 15.60 | 2.042 |
| | D | 110 | 4.300 | 0.255 | 15.90 | 14.56 | 1.850 |
| | E | 20 | 4.150 | 0.247 | 14.82 | 13.56 | 1.673 |
| | F | 40 | 3.900 | 0.235 | 13.10 | 11.97 | 1.407 |
| | G | 12 | 2.850 | 0.194 | 7.03 | 6.39 | 0.619 |
| Comp. Ex. 4 | A | 108 | 4.500 | 0.254 | 18.82 | 15.95 | 2.021 |
| | B | 78 | 4.400 | 0.249 | 17.99 | 15.25 | 1.892 |
| | C | 20 | 4.300 | 0.244 | 17.19 | 14.56 | 1.770 |
| | D | 100 | 4.100 | 0.234 | 15.63 | 13.23 | 1.544 |
| | E | 18 | 3.600 | 0.211 | 12.07 | 10.20 | 1.075 |

TABLE 3

Results of Evaluation

Figure 2:
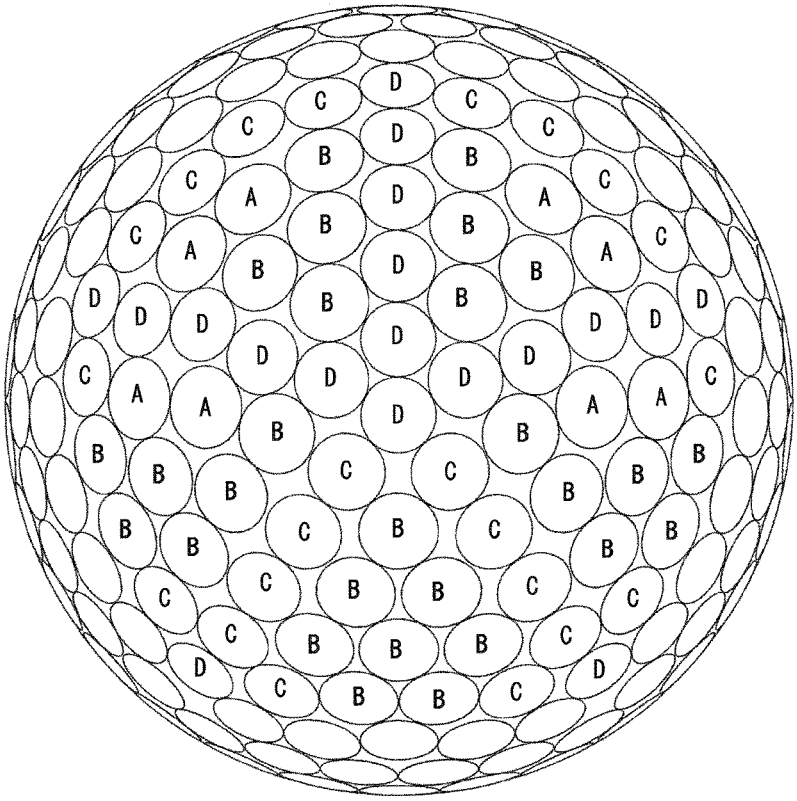
FIG. 2 is an enlarged plan view of the golf ball in FIG. 1.
Figure 3:
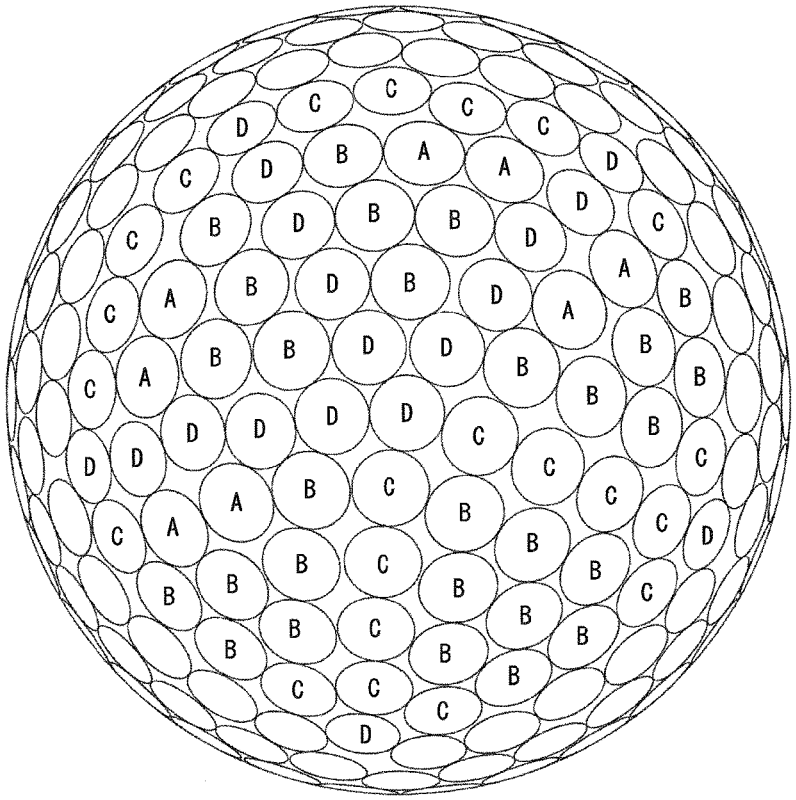
FIG. 3 is a bottom view of the golf ball in FIG. 2.
Figure 4:
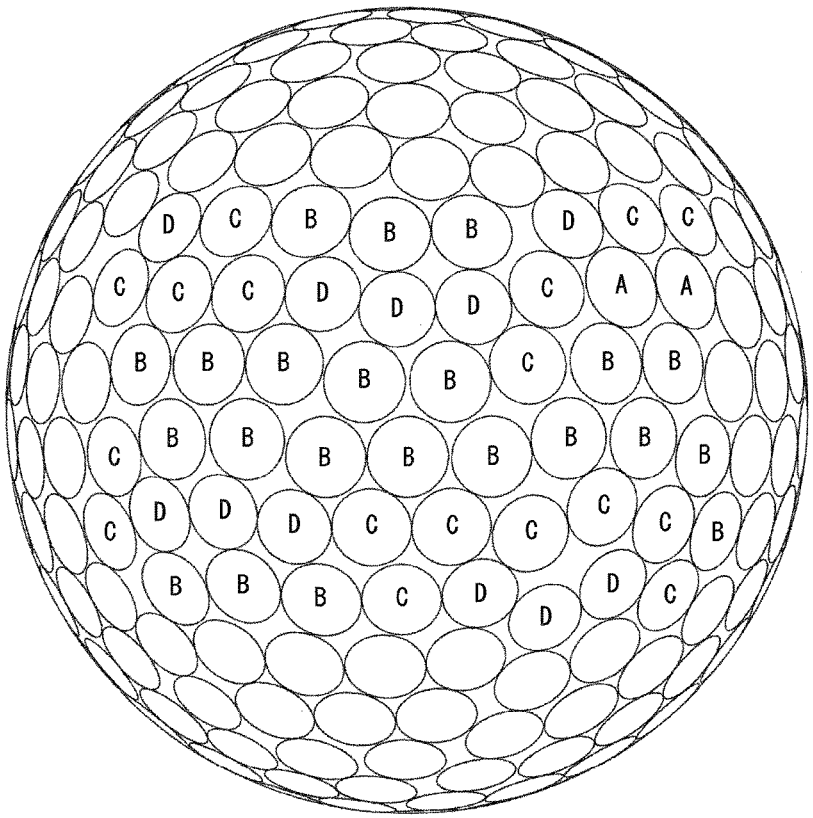
FIG. 4 is a right side view of the golf ball in FIG. 2.
Figure 5:
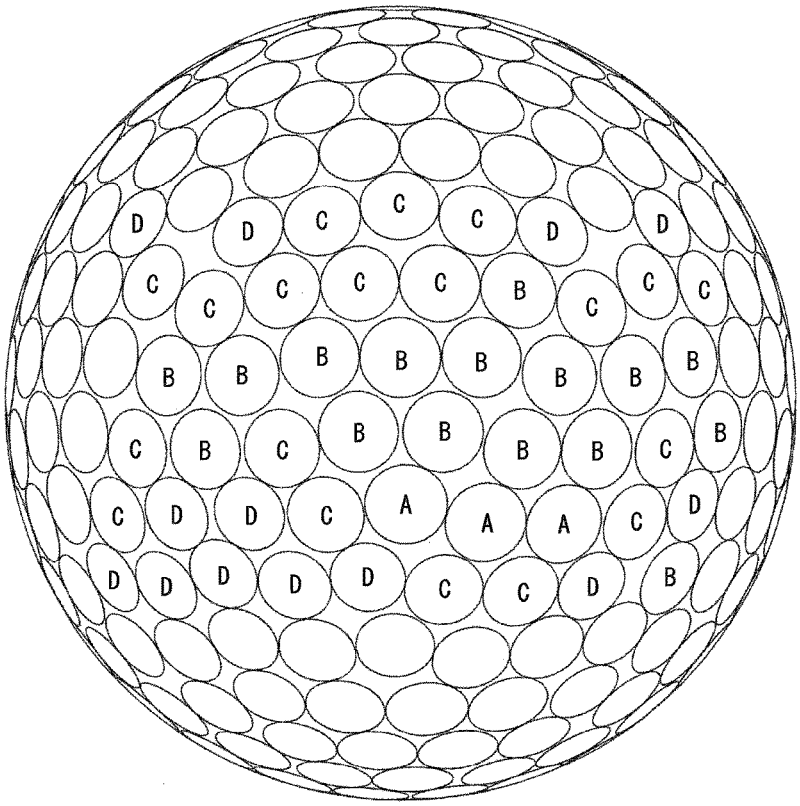
FIG. 5 is a front view of the golf ball in FIG. 2.
Figure 6:
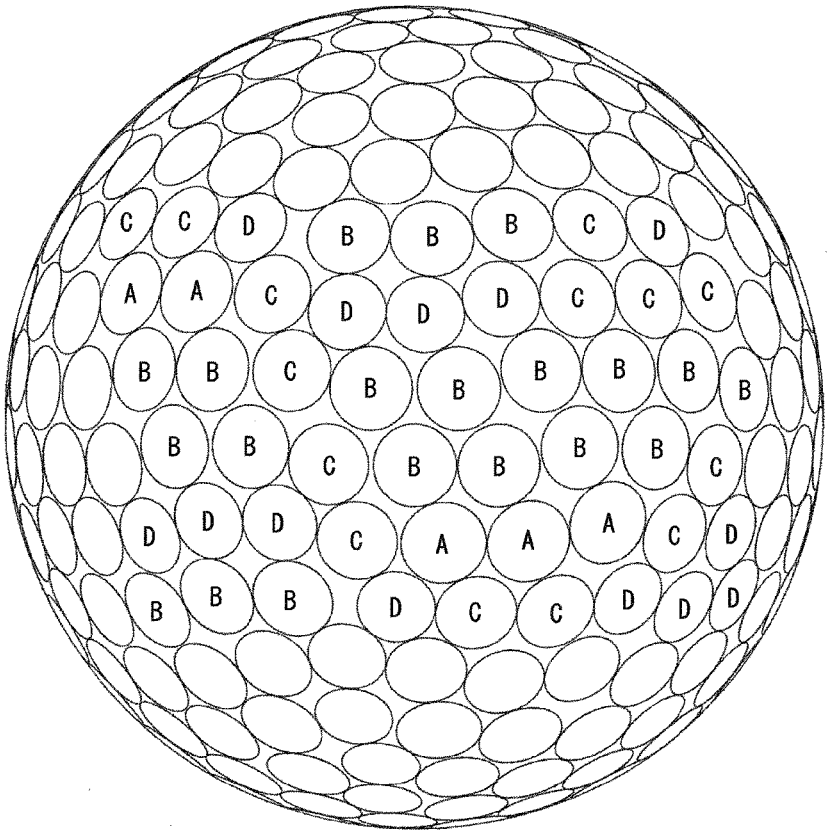
FIG. 6 is a left side view of the golf ball in FIG. 2.
Figure 7:
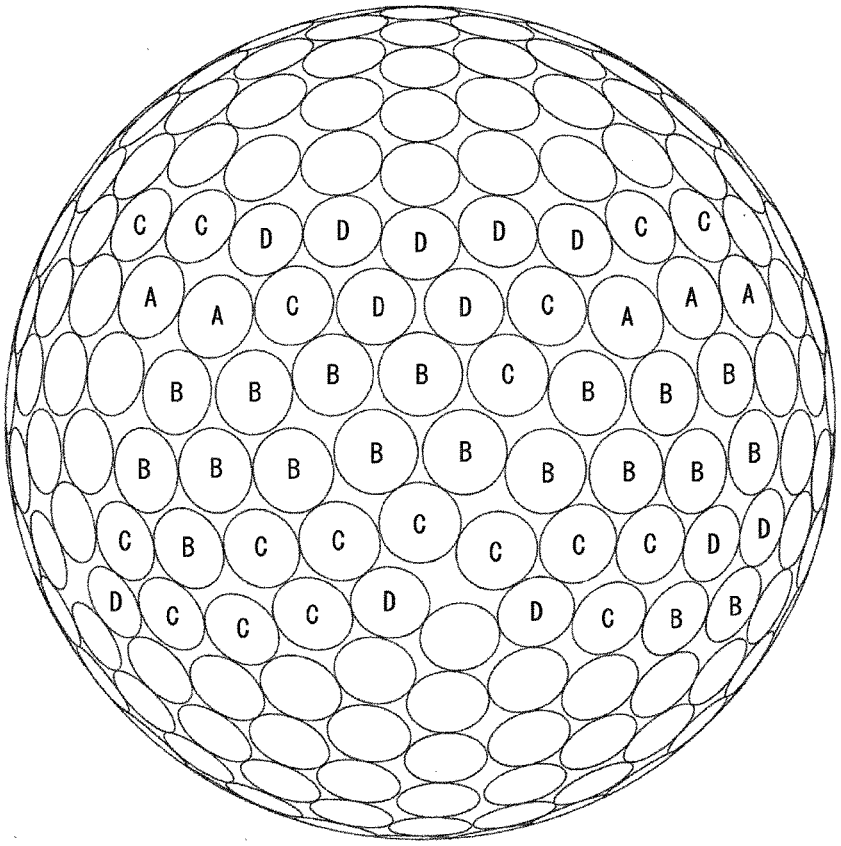
FIG. 7 is a back view of the golf ball in FIG. 2.
Figure 17:
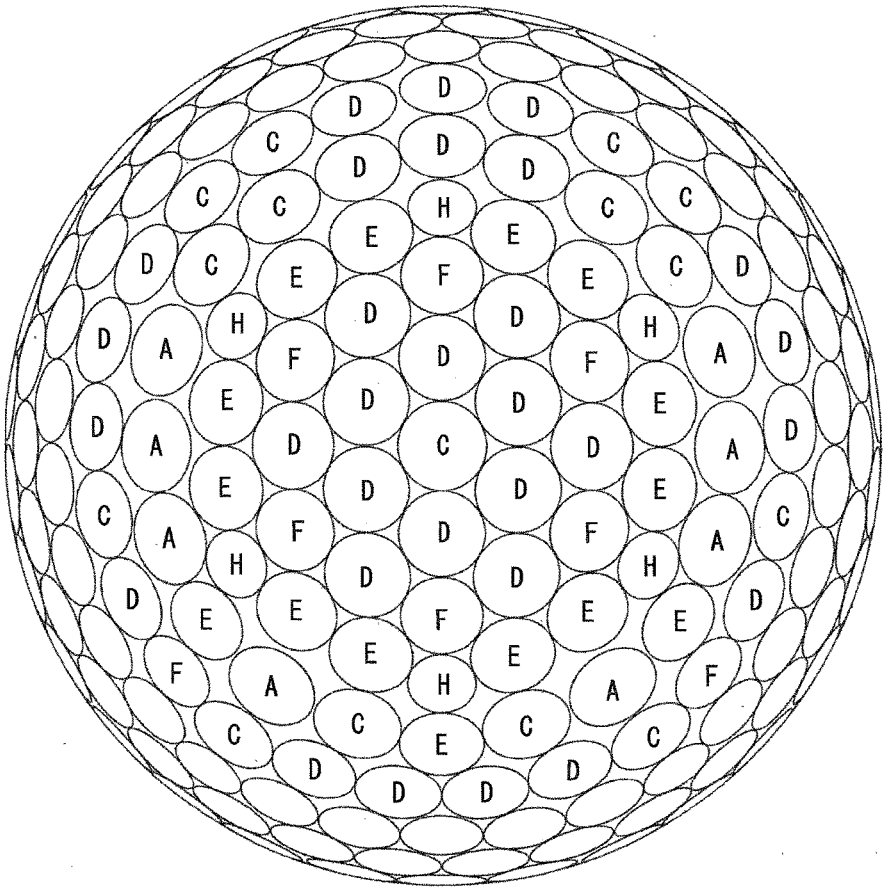
FIG. 17 is a plan view of a golf ball according to Example 1 of the present invention.
Figure 18:
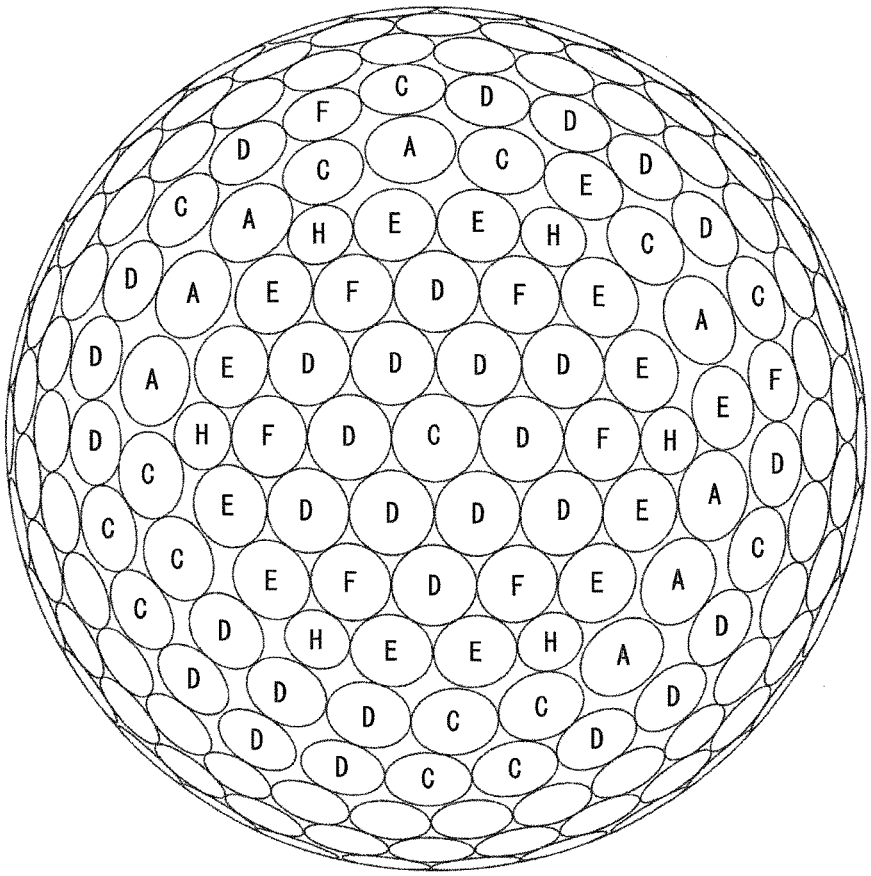
FIG. 18 is a bottom view of the golf ball in FIG. 17.
Figure 19:
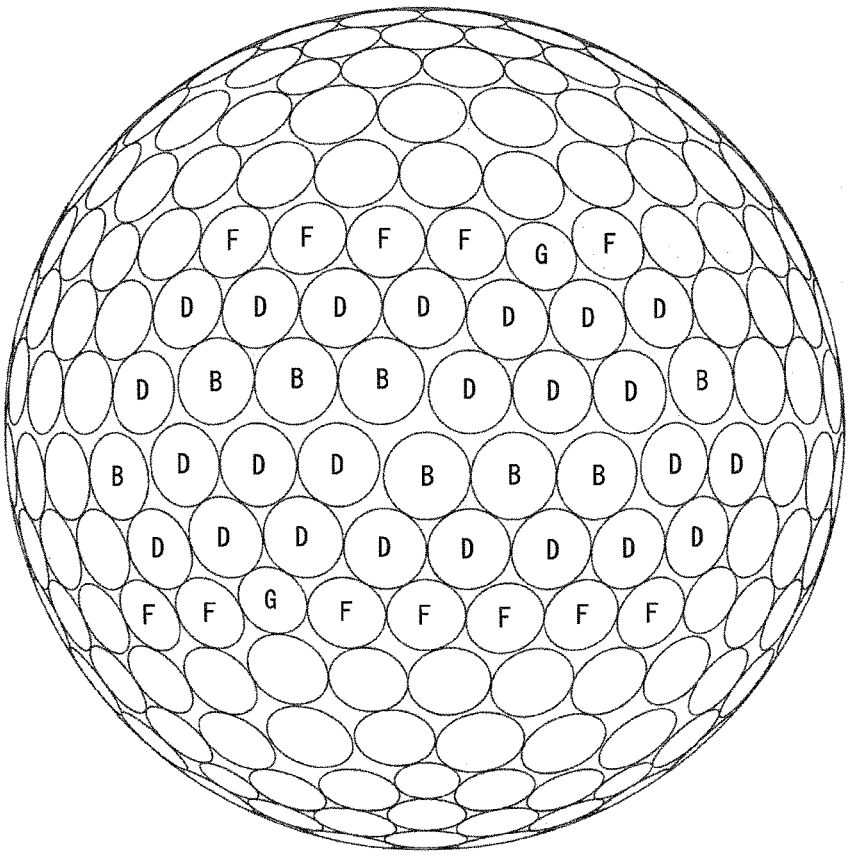
FIG. 19 is a right side view of the golf ball in FIG. 17.
Figure 20:
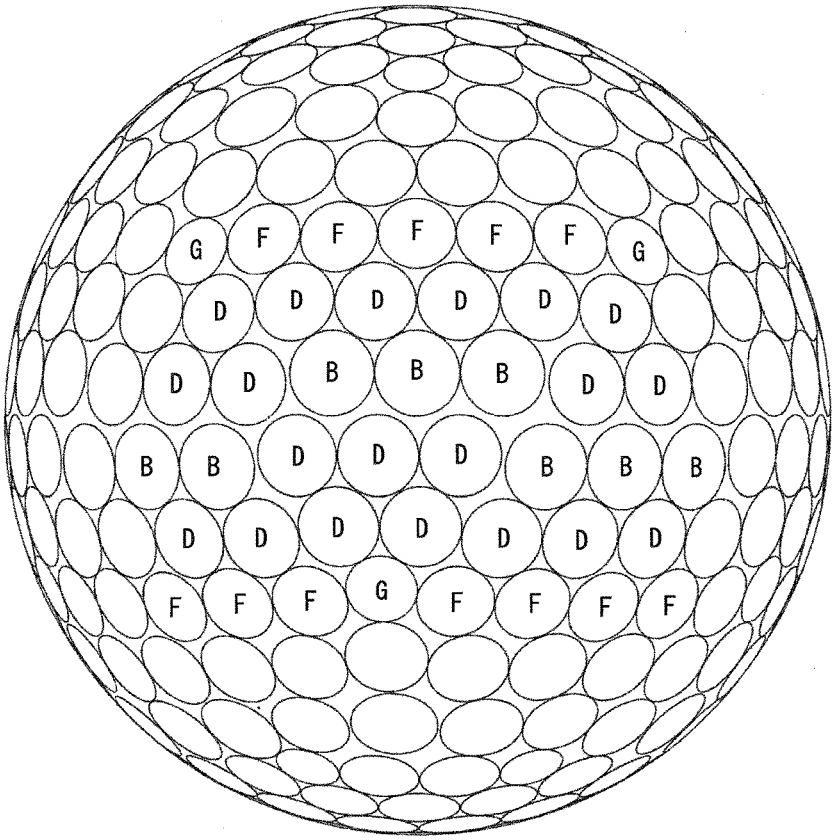
FIG. 20 is a front view of the golf ball in FIG. 17.
Figure 21:
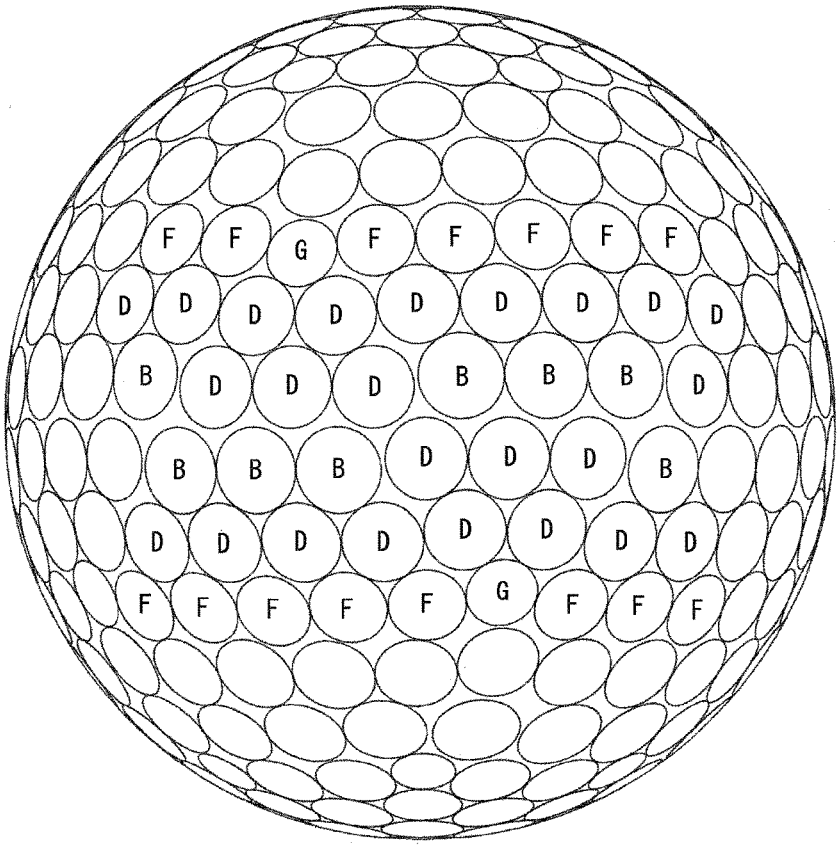
FIG. 21 is a left side view of the golf ball in FIG. 17.
Figure 22:
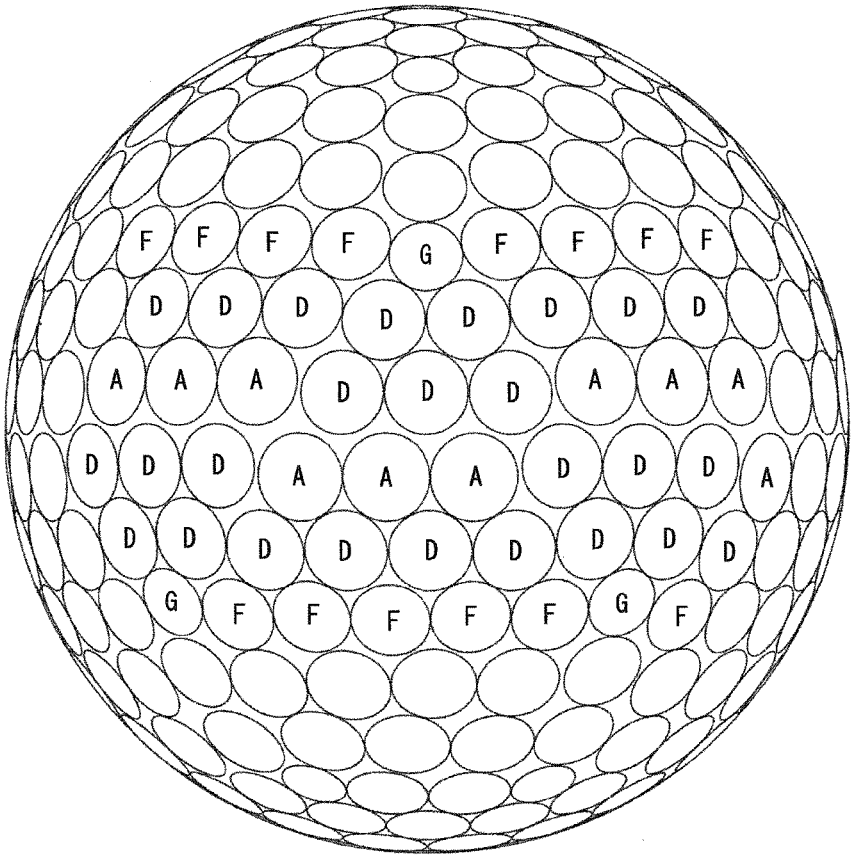
FIG. 22 is a back view of the golf ball in FIG. 17.
Figure 23:
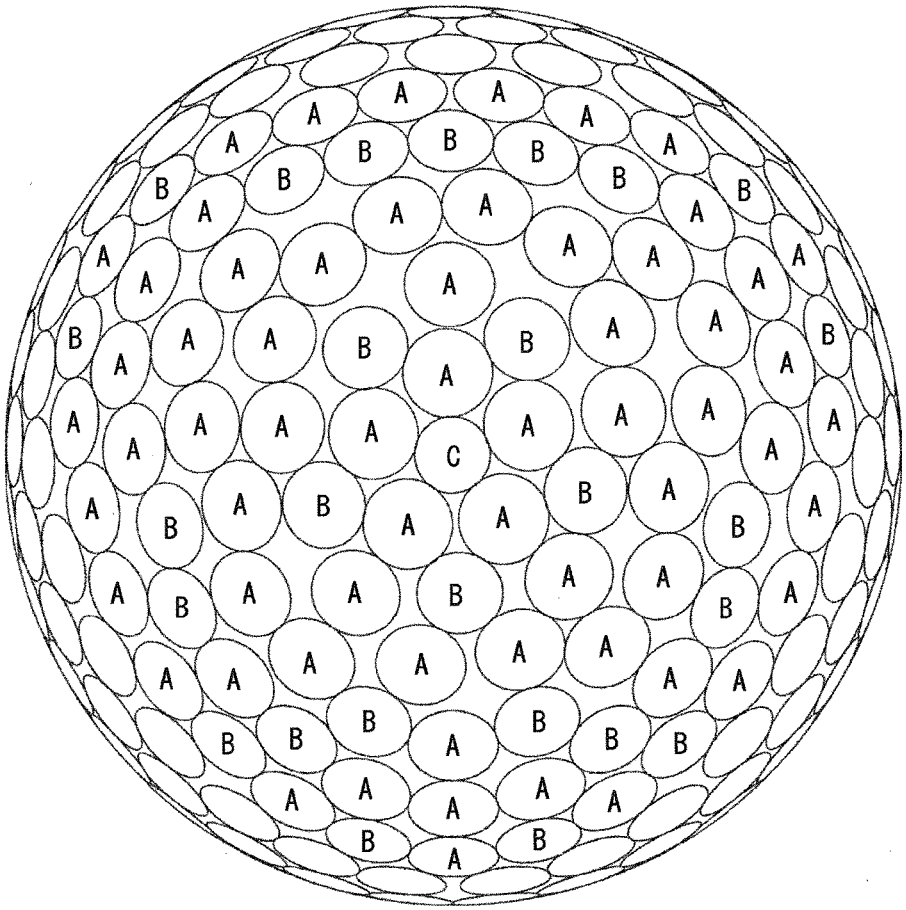
FIG. 23 is a plan view of a golf ball according to Example 3 of the present invention.
Figure 24:
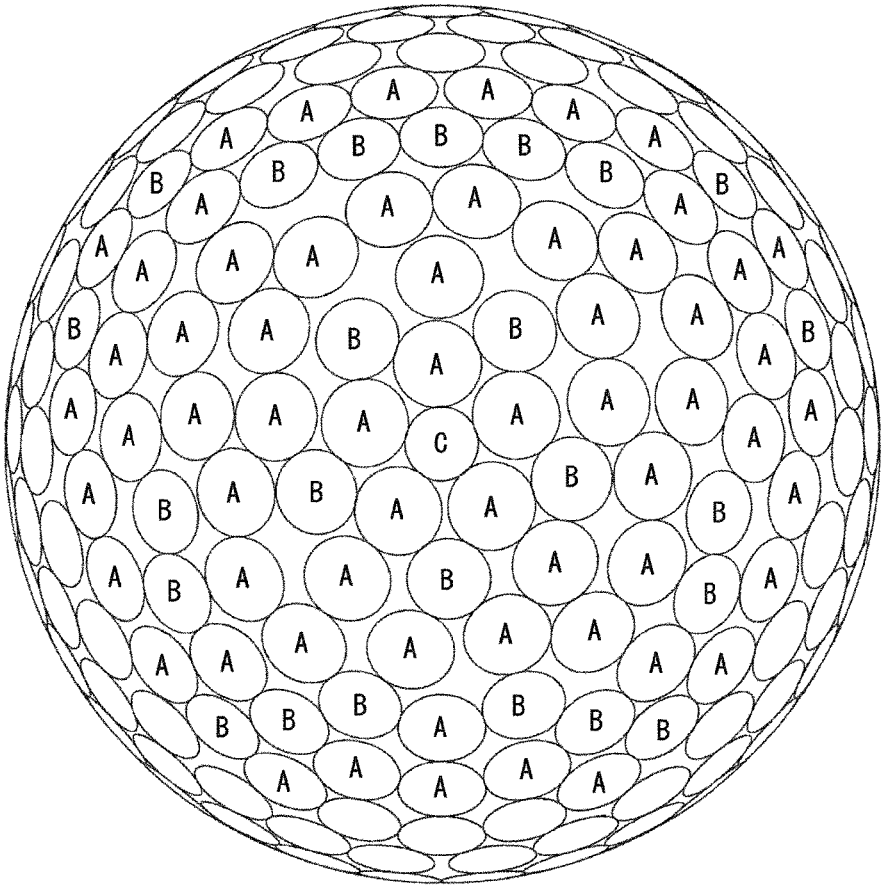
FIG. 24 is a bottom view of the golf ball in FIG. 23.
Figure 25:
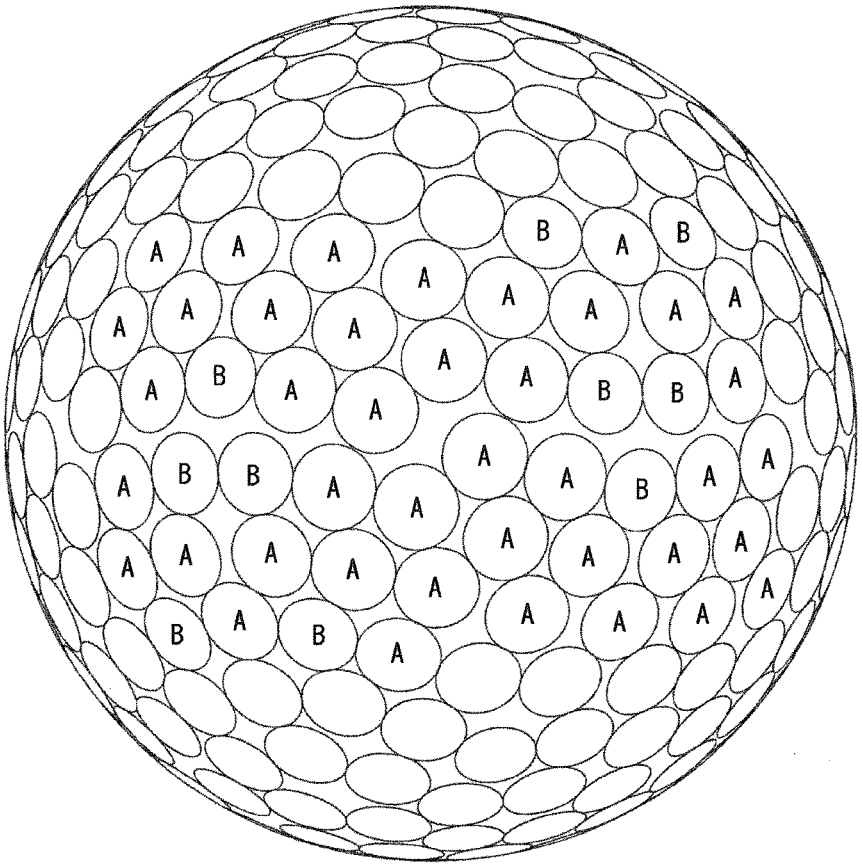
FIG. 25 is a right side view of the golf ball in FIG. 23.
Figure 26:
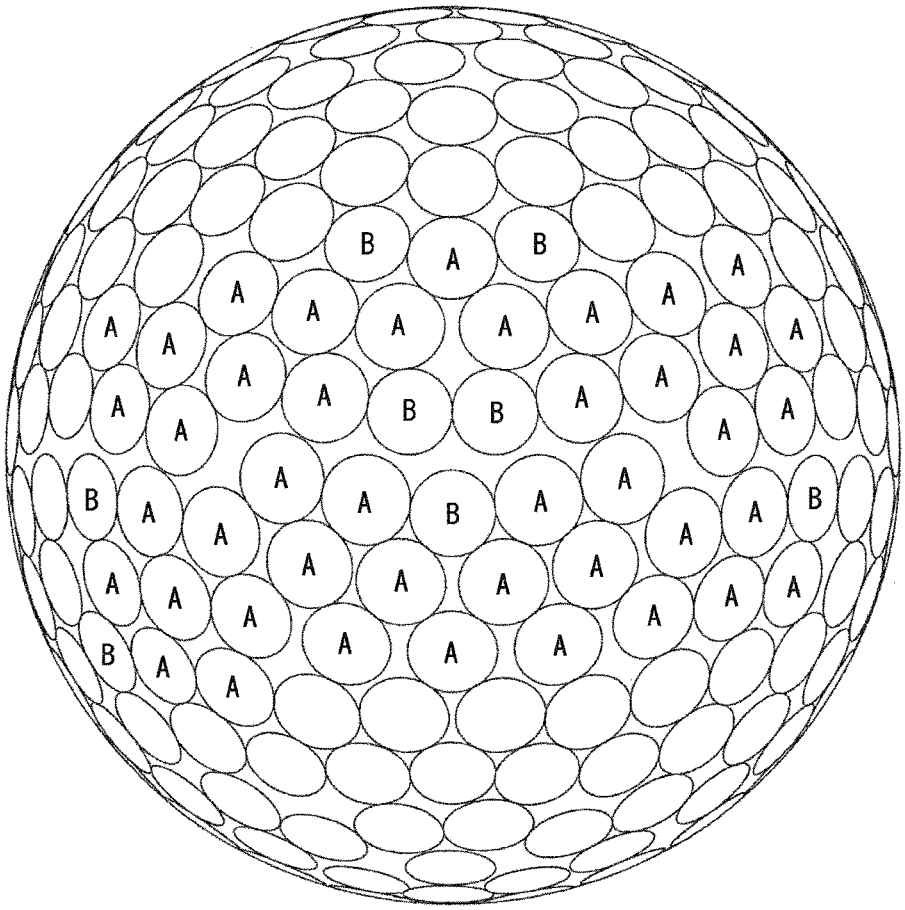
FIG. 26 is a front view of the golf ball in FIG. 23.
Figure 27:
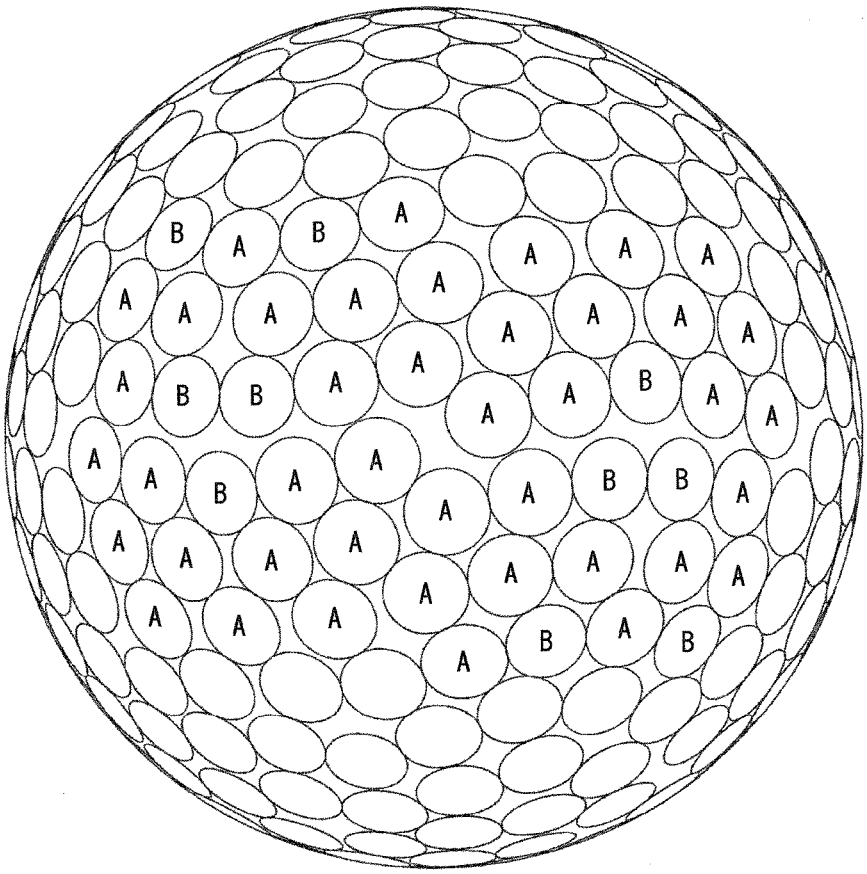
FIG. 27 is a left side view of the golf ball in FIG. 23.
Figure 28:
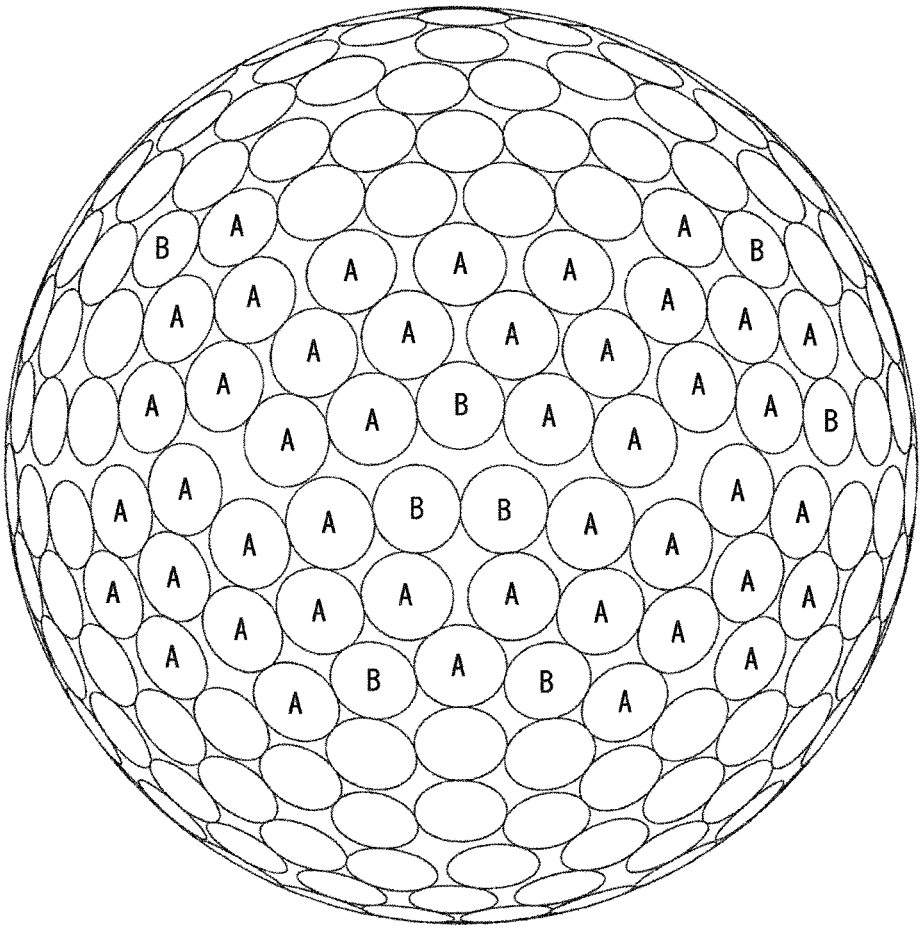
FIG. 28 is a back view of the golf ball in FIG. 23.
Figure 29:
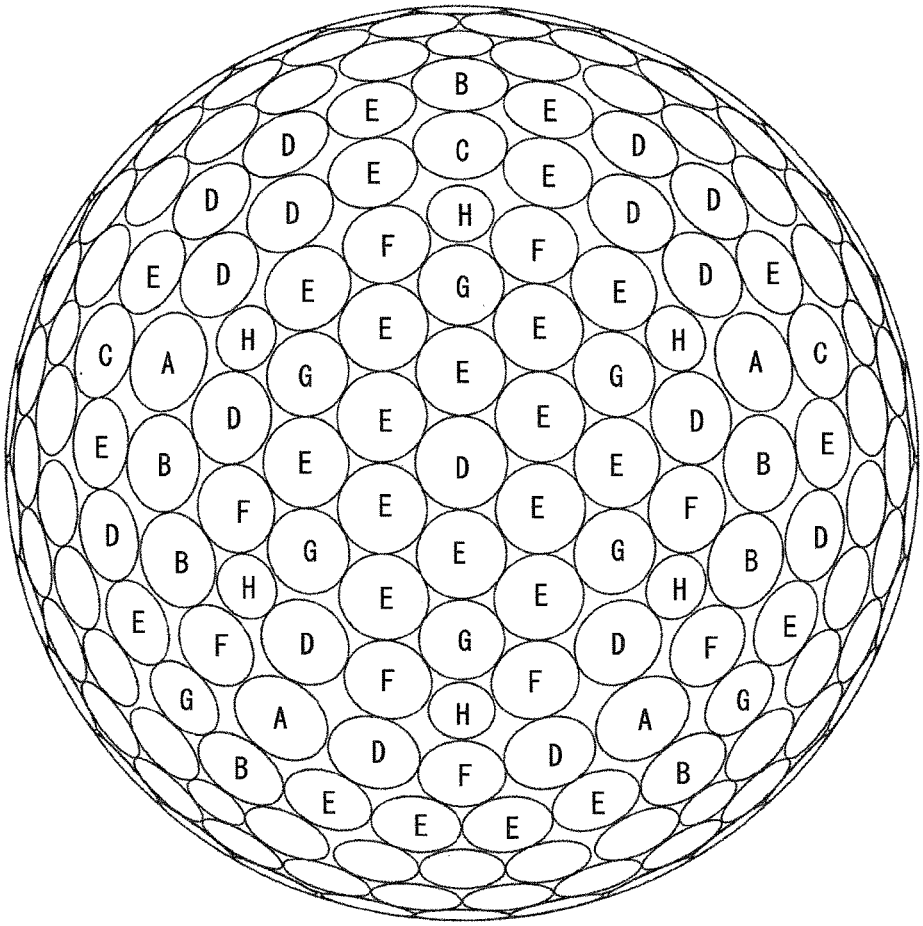
FIG. 29 is a plan view of a golf ball according to Example 4 of the present invention.
Figure 30:
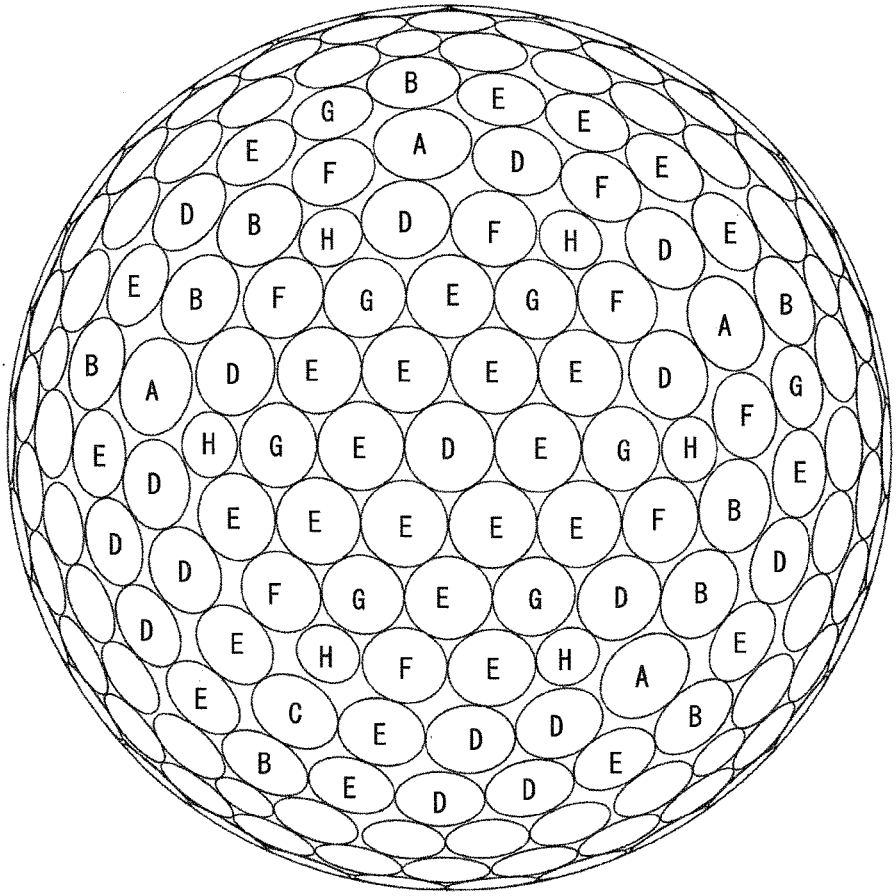
FIG. 30 is a bottom view of the golf ball in FIG. 29.
Figure 31:
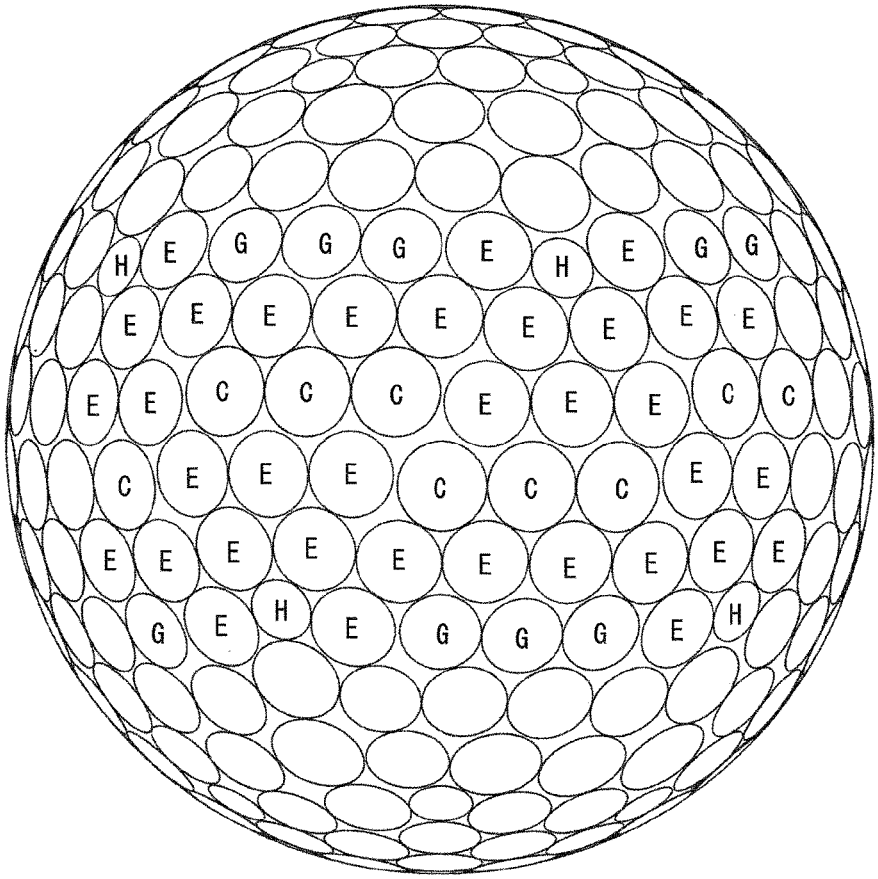
FIG. 31 is a right side view of the golf ball in FIG. 29.
Figure 32:
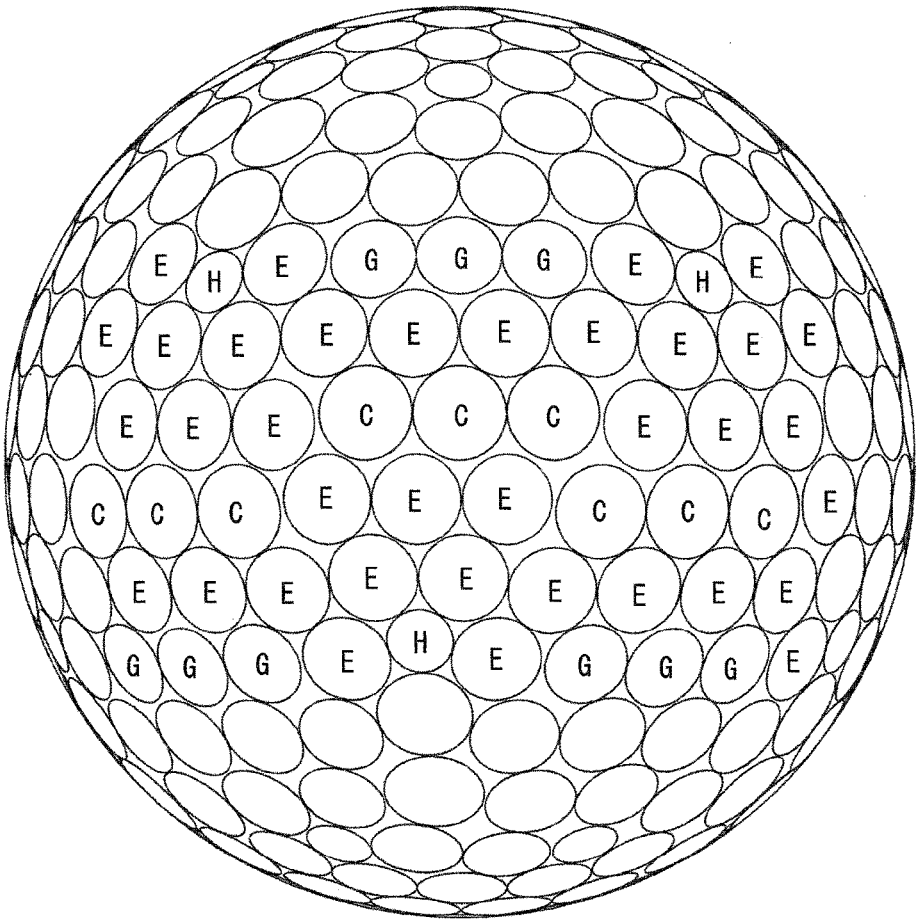
FIG. 32 is a front view of the golf ball in FIG. 29.
Figure 33:
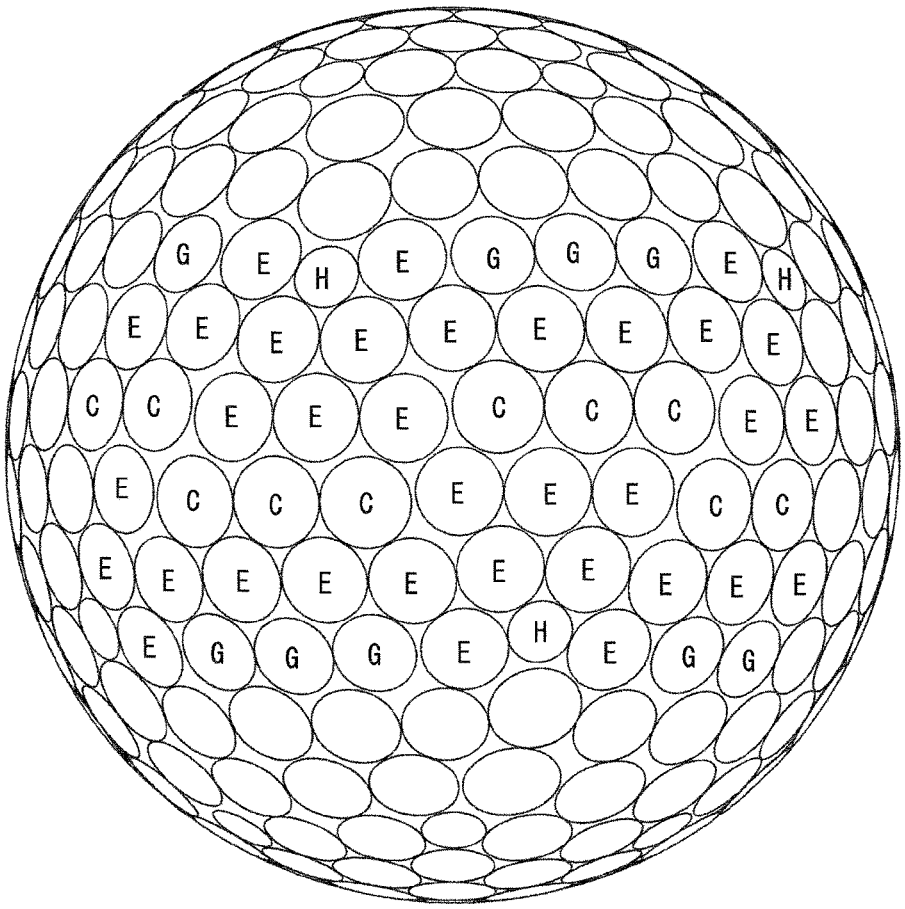
FIG. 33 is a left side view of the golf ball in FIG. 29.
Figure 34:
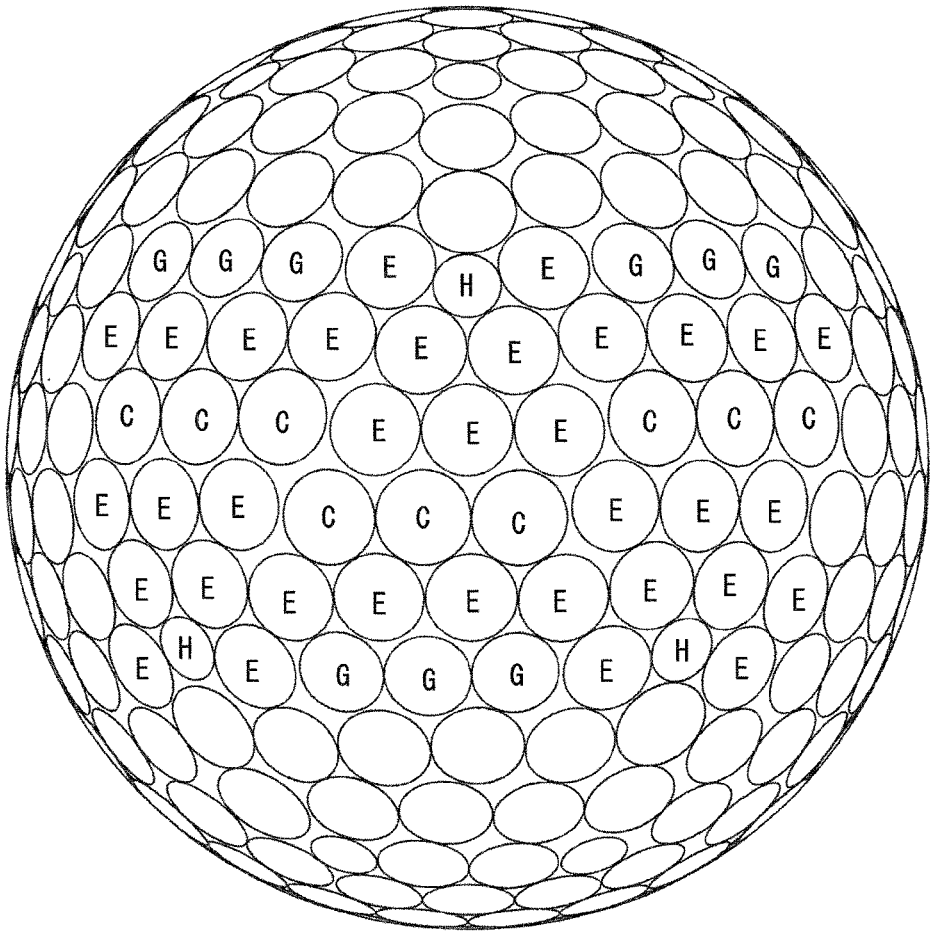
FIG. 34 is a back view of the golf ball in FIG. 29.
Figure 35:
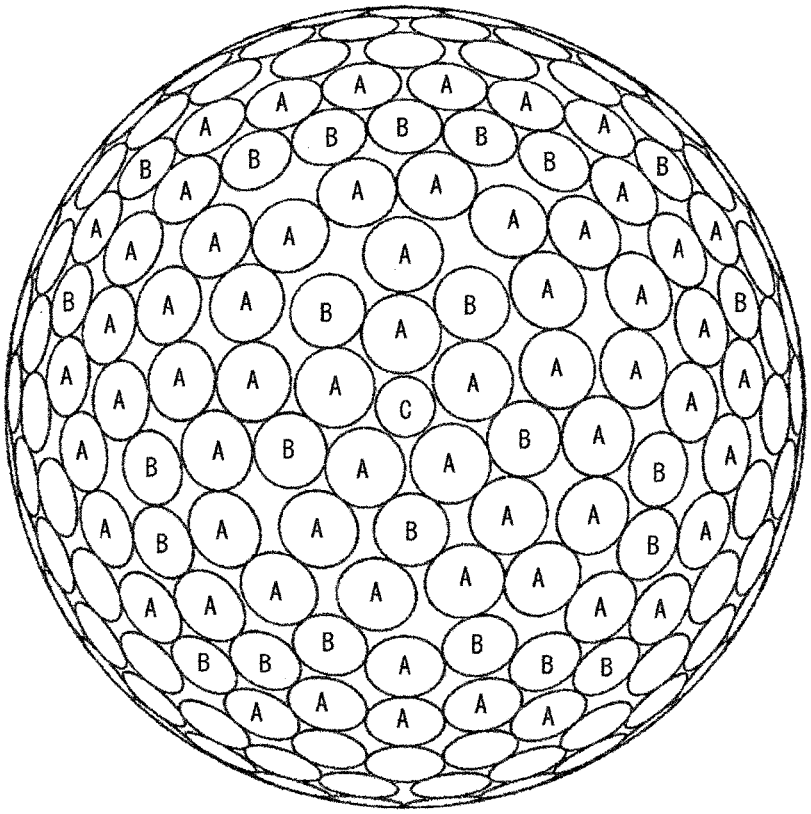
FIG. 35 is a plan view of a golf ball according to Example 5 of the present invention.
Figure 36:
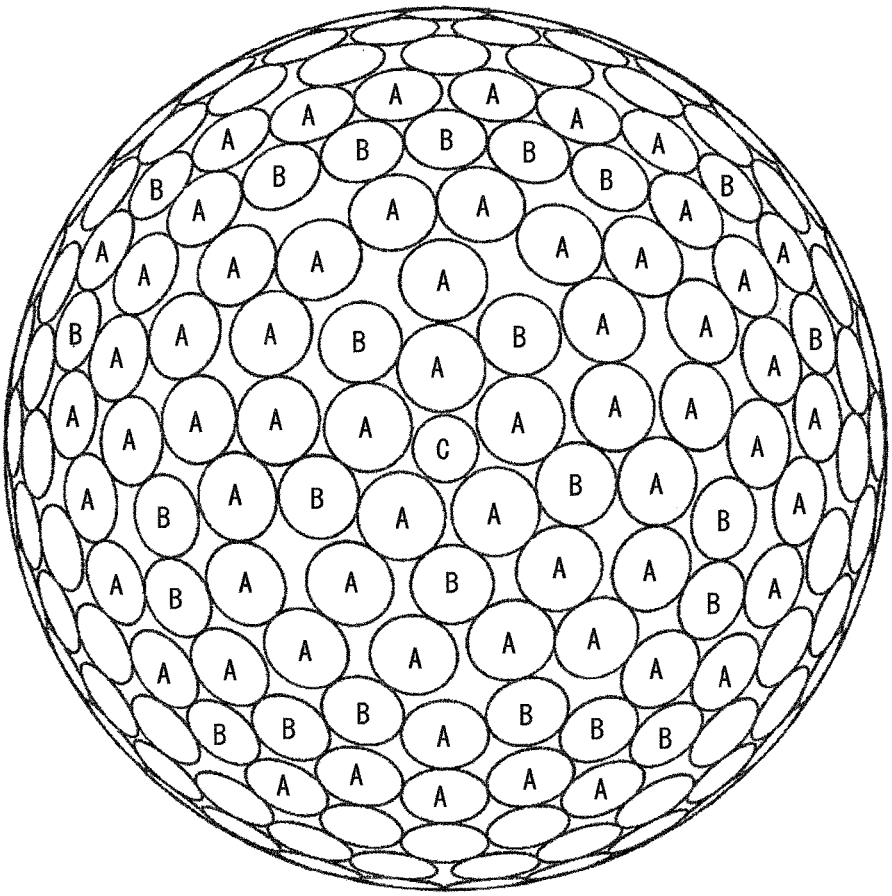
FIG. 36 is a bottom view of the golf ball in FIG. 35.
Figure 37:
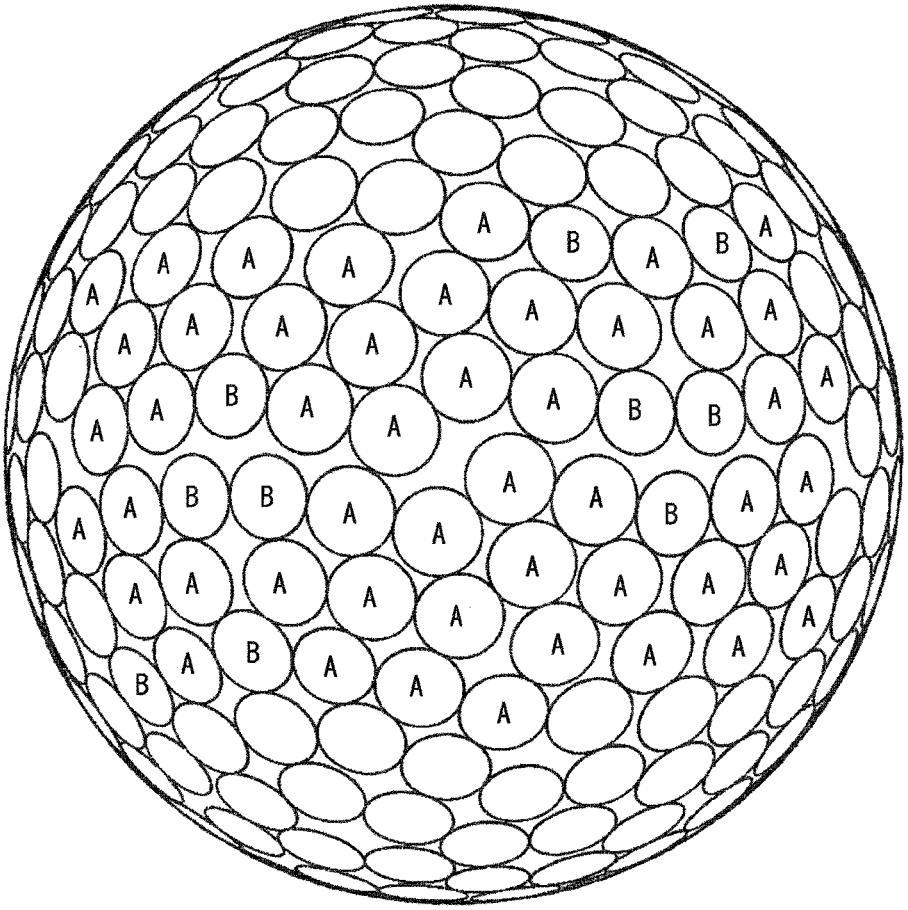
FIG. 37 is a right side view of the golf ball in FIG. 35.
Figure 38:
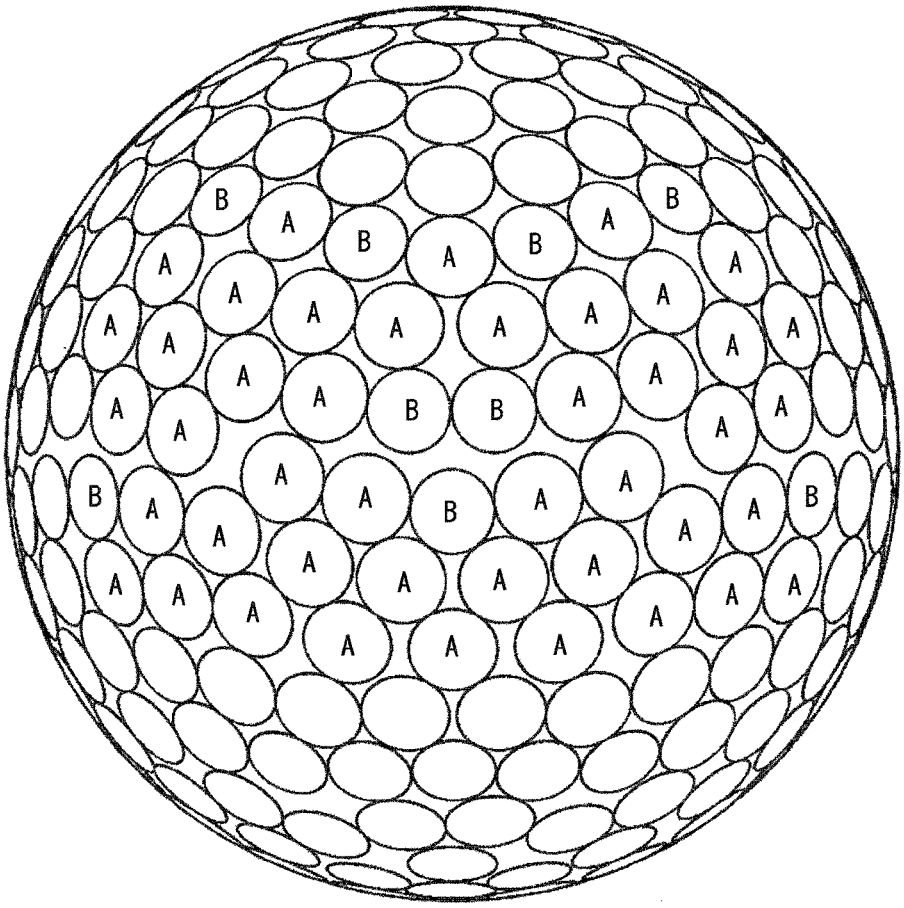
FIG. 38 is a front view of the golf ball in FIG. 35.
Figure 39:
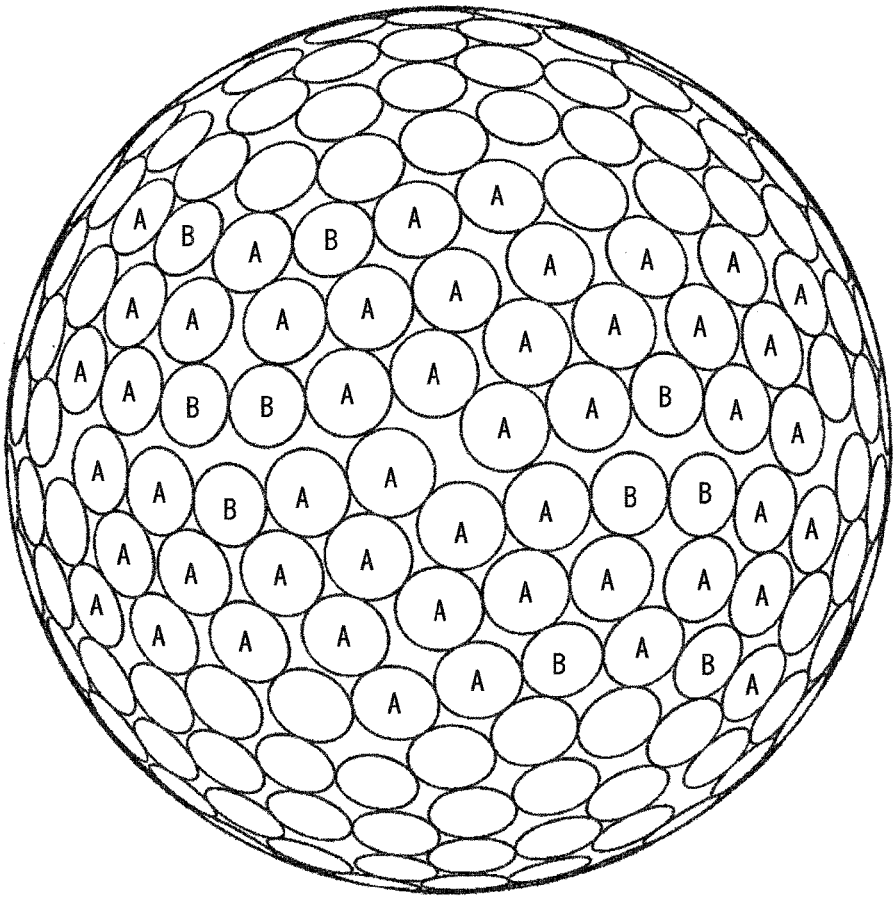
FIG. 39 is a left side view of the golf ball in FIG. 35.
Figure 40:
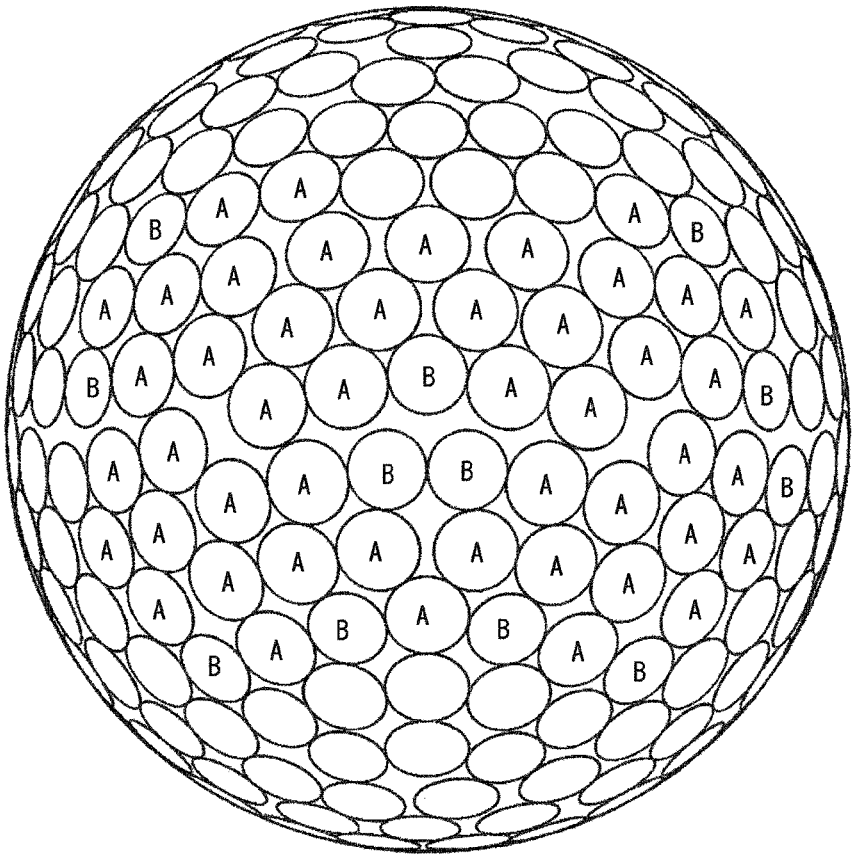
FIG. 40 is a back view of the golf ball in FIG. 35.

| | Ex. 1 | Ex. 2 | Ex. 3 | Ex. 4 | Ex. 5 |
|---|---|---|---|---|---|
| Plan view | FIG. 17 | FIG. 2 | FIG. 23 | FIG. 29 | FIG. 35 |
| Bottom view | FIG. 18 | FIG. 3 | FIG. 24 | FIG. 30 | FIG. 36 |
| Right side view | FIG. 19 | FIG. 4 | FIG. 25 | FIG. 31 | FIG. 37 |
| Front view | FIG. 20 | FIG. 5 | FIG. 26 | FIG. 32 | FIG. 38 |
| Left side view | FIG. 21 | FIG. 6 | FIG. 27 | FIG. 33 | FIG. 39 |
| Back view | FIG. 22 | FIG. 7 | FIG. 28 | FIG. 34 | FIG. 40 |
| Number N of dimples | 344 | 324 | 324 | 324 | 324 |
| Shape | Circle | Circle | Circle | Circle | Circle |
| Occupation ratio So | 0.855 | 0.832 | 0.806 | 0.801 | 0.807 |
| Standard deviation Su ($mm^2$) | 1.425 | 0.742 | 0.632 | 0.831 | 0.377 |
| Average area Sa ($mm^2$) | 14.24 | 14.71 | 14.25 | 14.16 | 14.26 |
| Formula (I) | Met | Met | Met | Met | Met |
| Formula (II) | Met | Met | Met | Met | Met |
| Formula (III) | Unmet | Met | Met | Unmet | Met |
| Formula (IV) | Unmet | Met | Unmet | Unmet | Met |
| Flight distance (m) | 260.6 | 259.8 | 258.2 | 257.1 | 259.4 |

TABLE 4

Results of Evaluation

| | Comp. Ex. 1 | Comp. Ex. 2 | Comp. Ex. 3 | Comp. Ex. 4 |
|---|---|---|---|---|
| Number N of dimples | 324 | 360 | 332 | 324 |
| Shape | Circle | Circle | Circle | Circle |
| Occupation ratio So | 0.808 | 0.775 | 0.851 | 0.822 |
| Standard deviation Su ($mm^2$) | 1.241 | 0.479 | 2.185 | 1.535 |
| Average area Sa ($mm^2$) | 14.28 | 12.33 | 14.68 | 14.54 |

TABLE 4-continued

| Results of Evaluation | | | | |
|---|---|---|---|---|
| | Comp. Ex. 1 | Comp. Ex. 2 | Comp. Ex. 3 | Comp. Ex. 4 |
| Formula (I) | Unmet | Met | Unmet | Unmet |
| Formula (II) | Unmet | Met | Unmet | Unmet |
| Formula (III) | Unmet | Met | Unmet | Unmet |
| Formula (IV) | Unmet | Unmet | Unmet | Unmet |
| Flight distance (m) | 255.4 | 251.9 | 252.3 | 254.7 |

TABLE 5

Figure 41:
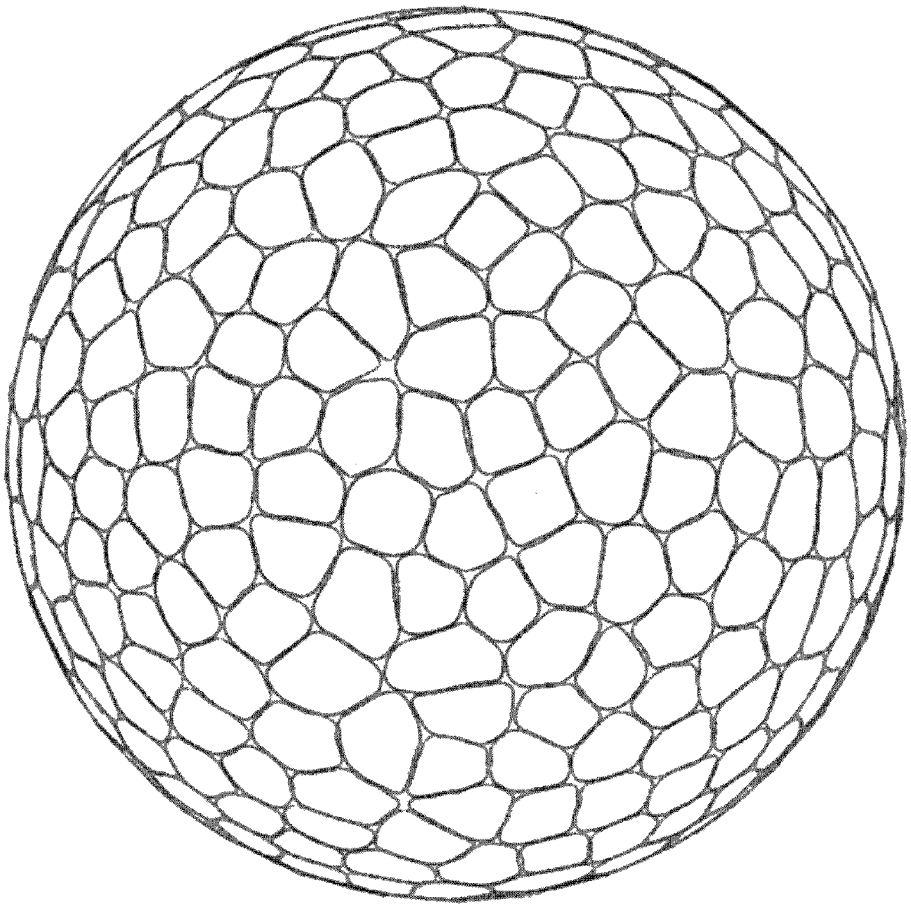
FIG. 41 is a front view of a golf ball according to Example 6 of the present invention.
Figure 42:
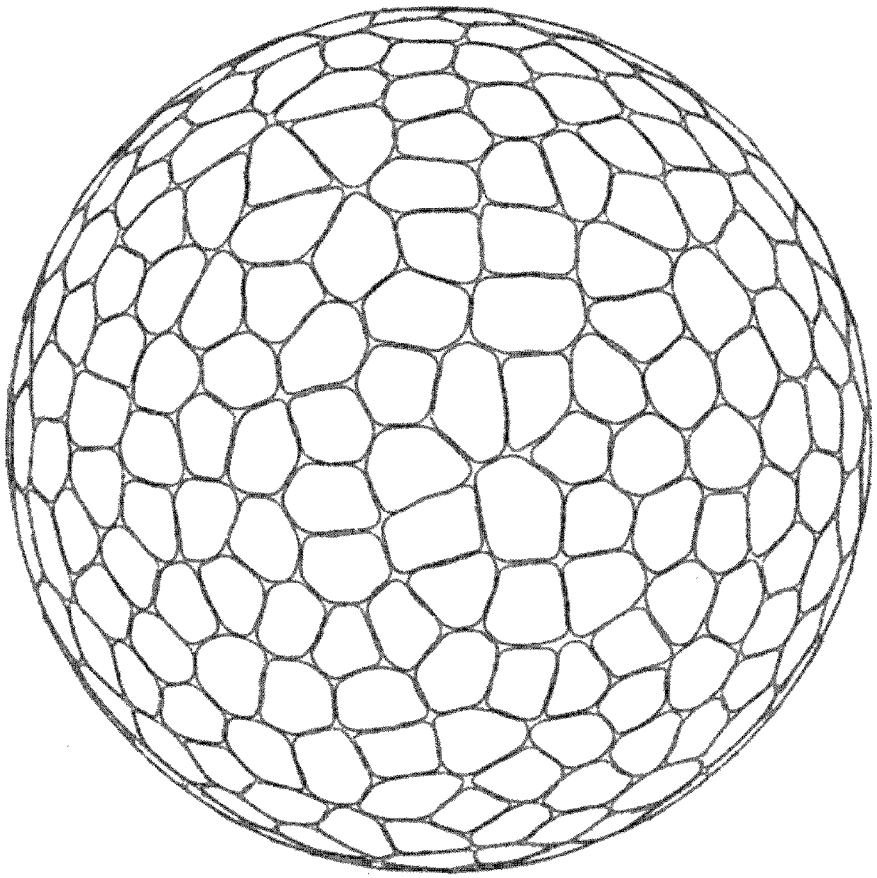
FIG. 42 is a plan view of the golf ball in FIG. 41.
Figure 43:
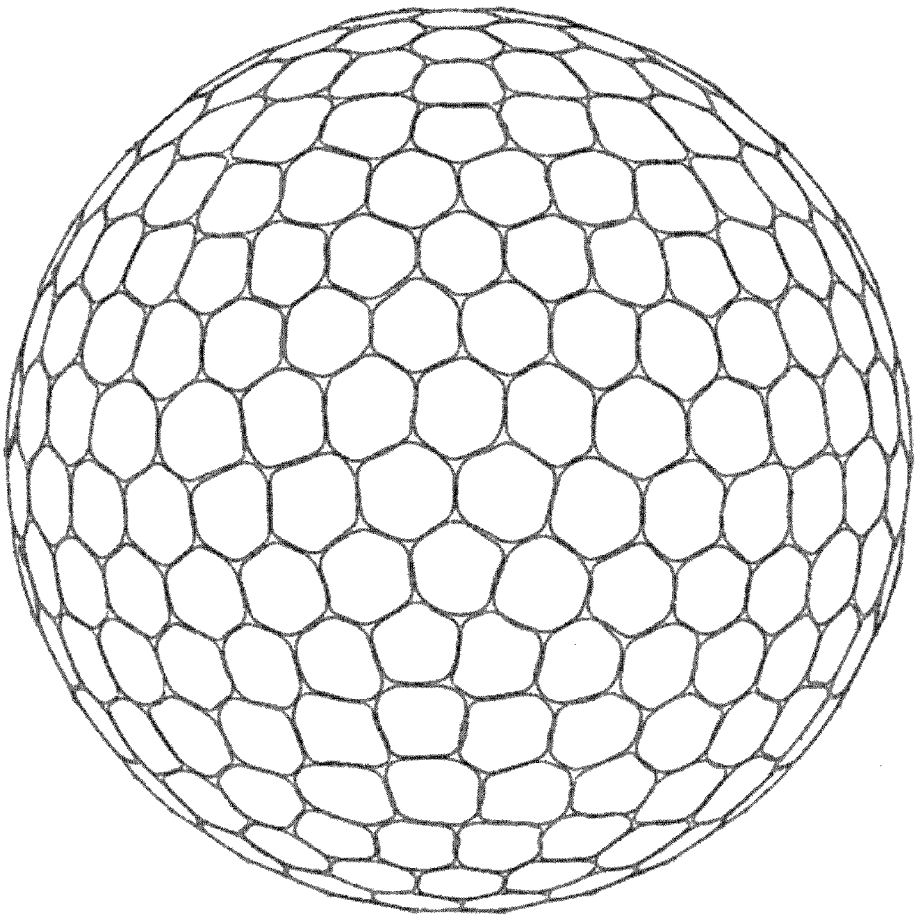
FIG. 43 is a front view of a golf ball according to Example 7 of the present invention.
Figure 44:
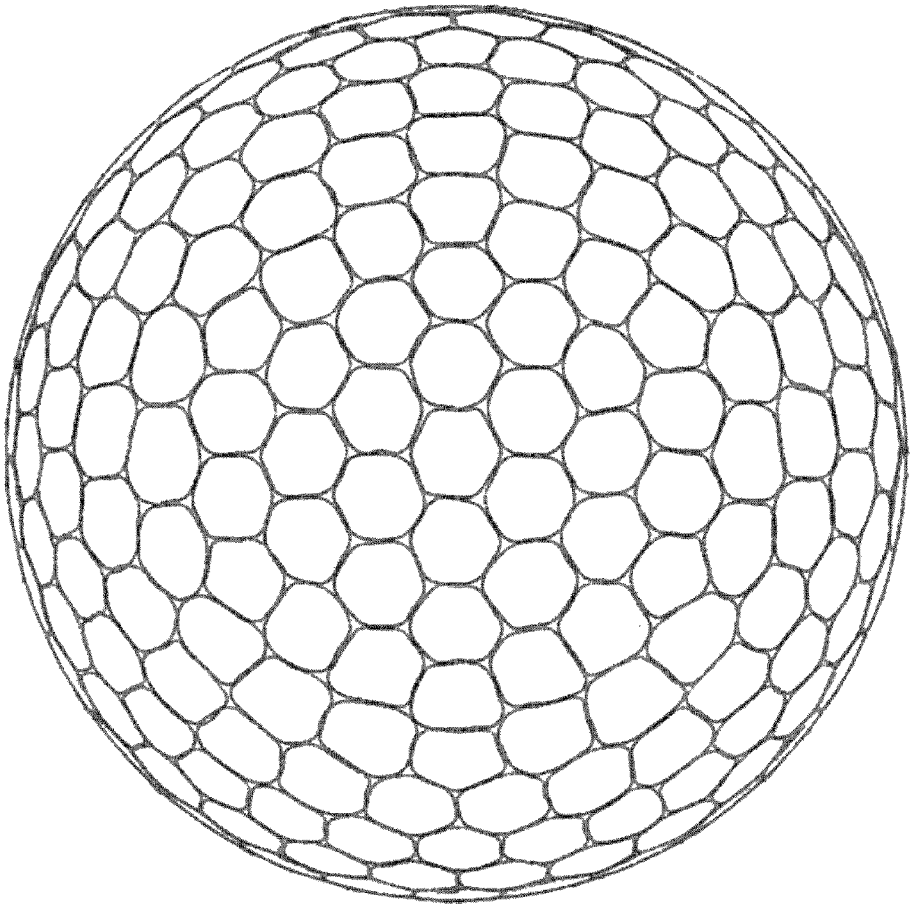
FIG. 44 is a plan view of the golf ball in FIG. 43.
Figure 45:
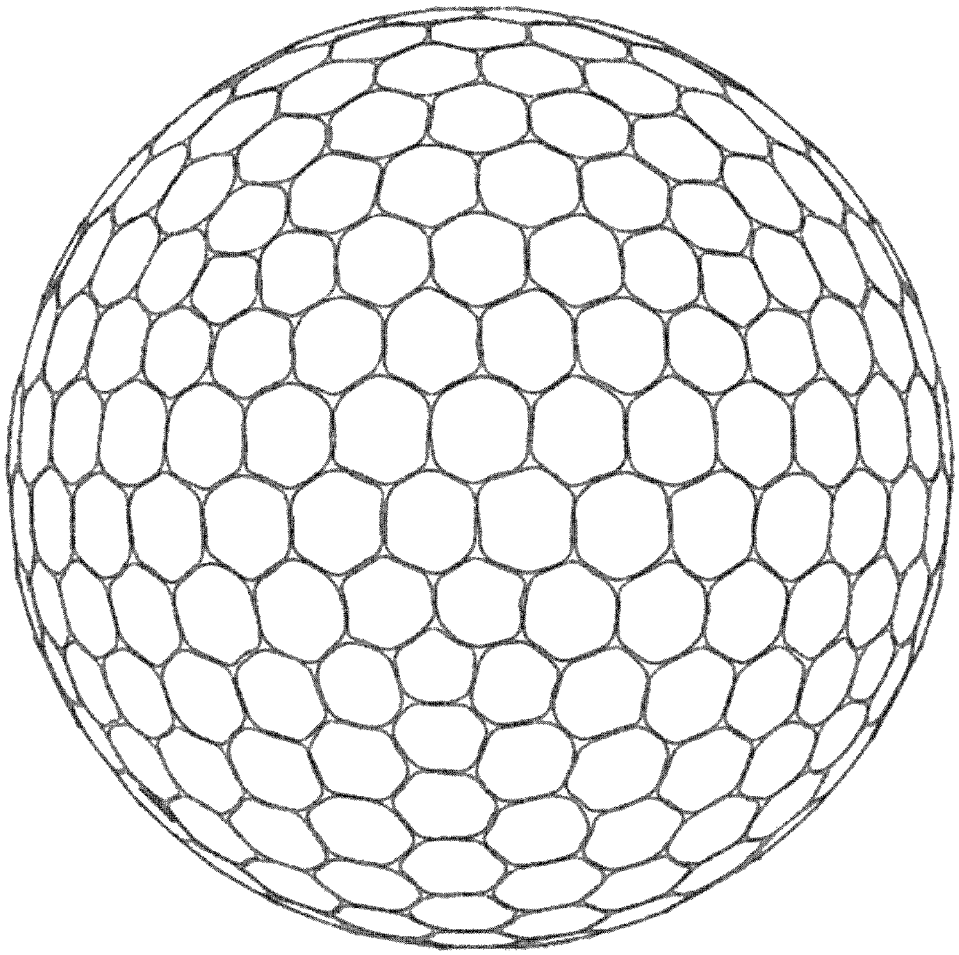
FIG. 45 is a front view of a golf ball according to Example 8 of the present invention.
Figure 46:
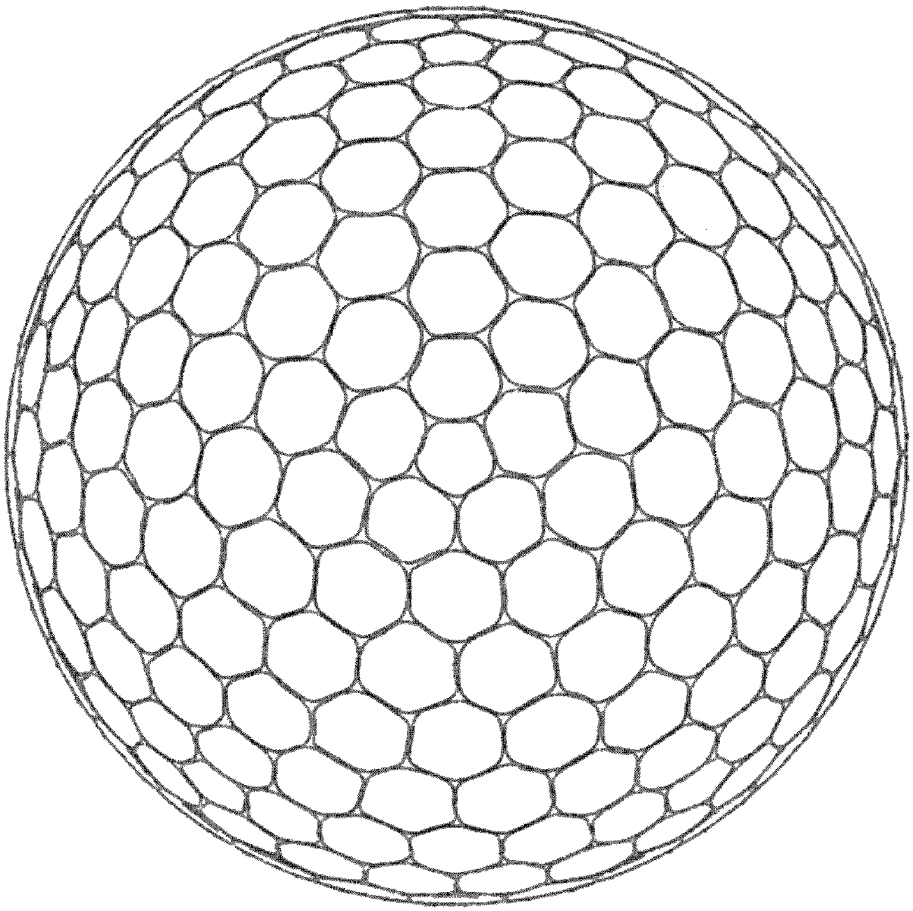
FIG. 46 is a plan view of the golf ball in FIG. 45.
Figure 47:
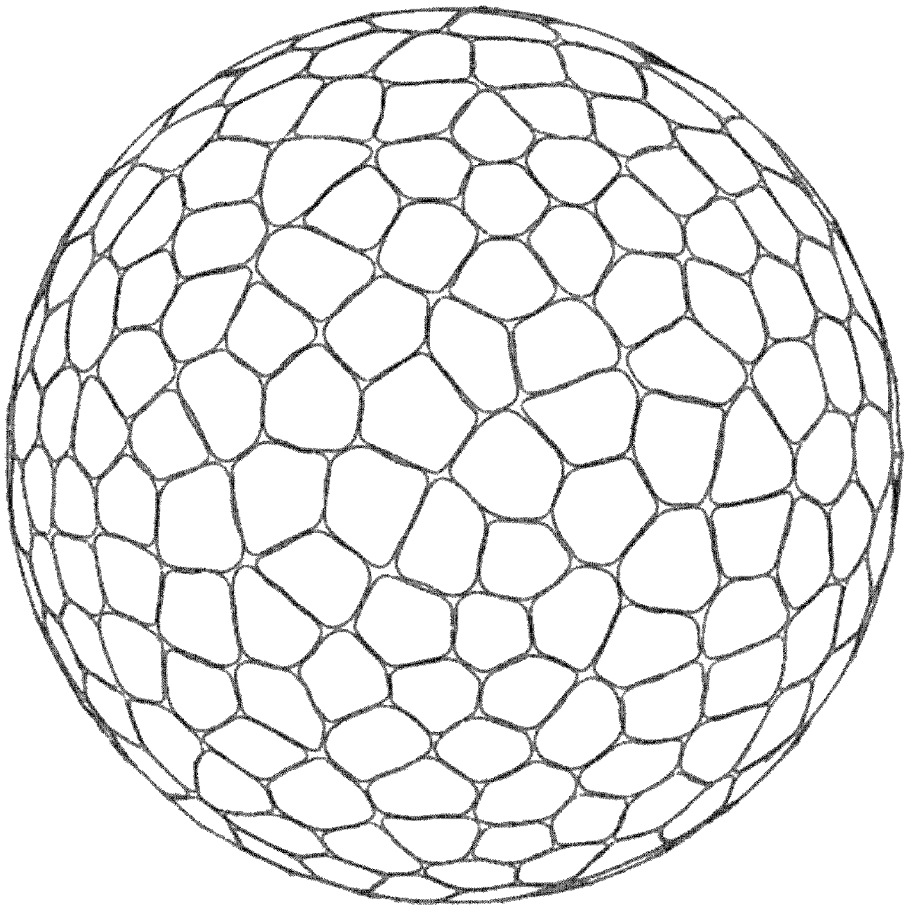
FIG. 47 is a front view of a golf ball according to Comparative Example 5.
Figure 48:
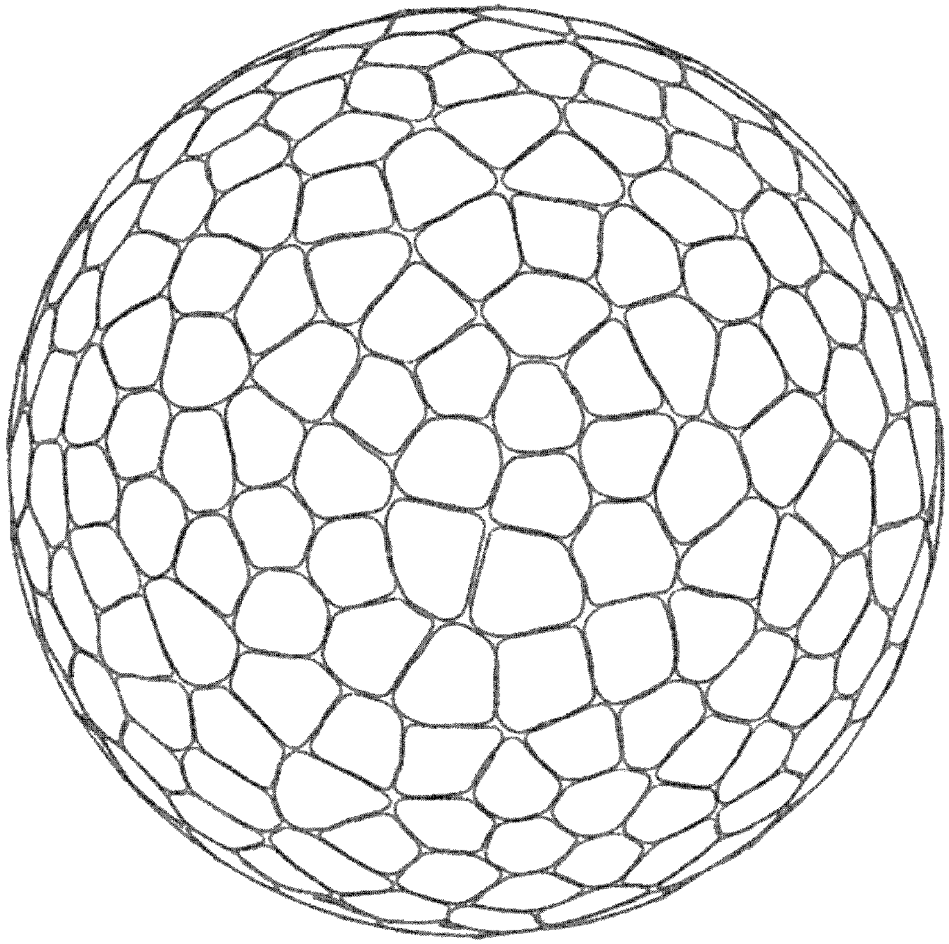
FIG. 48 is a plan view of the golf ball in FIG. 47.

| Results of Evaluation | | | | |
|---|---|---|---|---|
| | Ex. 6 | Ex. 7 | Ex. 8 | Comp. Ex. 5 |
| Front view | FIG. 41 | FIG. 43 | FIG. 45 | FIG. 47 |
| Plan view | FIG. 42 | FIG. 44 | FIG. 46 | FIG. 48 |
| Number N of dimples | 391 | 344 | 332 | 324 |
| Shape | Voronoi | Voronoi | Voronoi | Voronoi |
| Occupation ratio So | 0.920 | 0.920 | 0.920 | 0.920 |
| Standard deviation Su ($mm^2$) | 2.147 | 1.192 | 1.946 | 2.276 |
| Average area Sa ($mm^2$) | 13.48 | 15.32 | 15.87 | 16.26 |
| Formula (I) | Met | Met | Met | Unmet |
| Formula (II) | Unmet | Met | Met | Unmet |
| Formula (III) | Unmet | Met | Unmet | Unmet |
| Formula (IV) | Unmet | Met | Unmet | Unmet |
| Flight distance (m) | 259.6 | 263.5 | 261.4 | 255.8 |

TABLE 6

Figure 49:
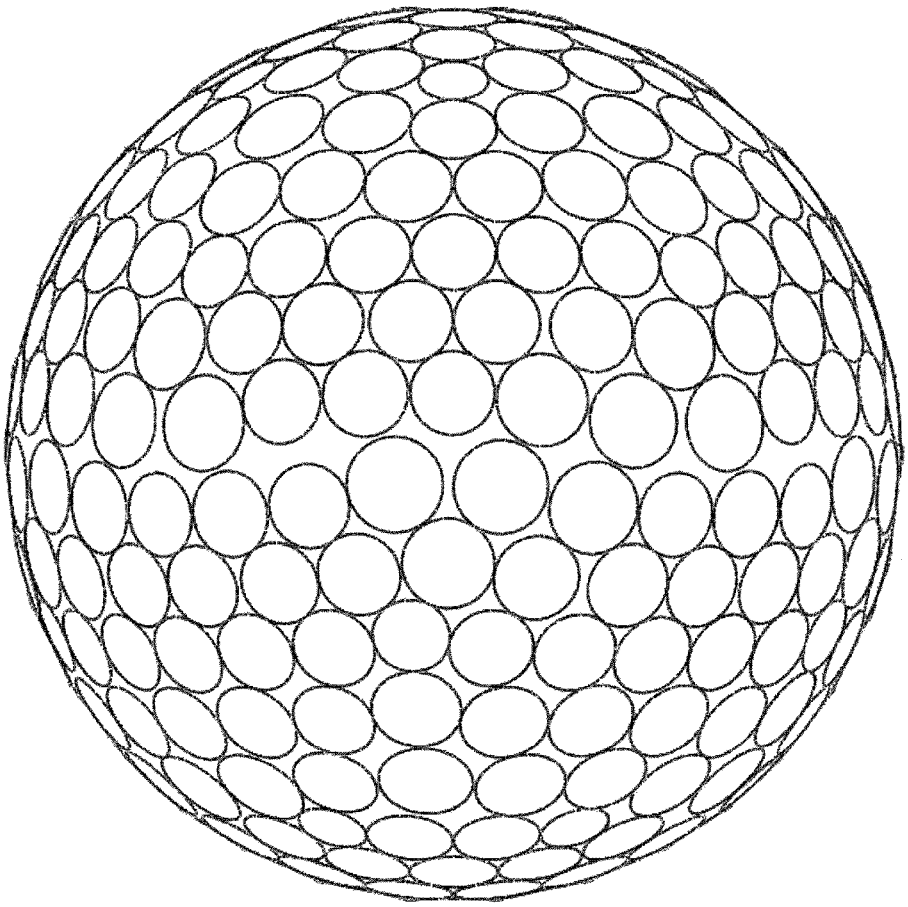
FIG. 49 is a front view of a golf ball according to Example 9 of the present invention.
Figure 50:
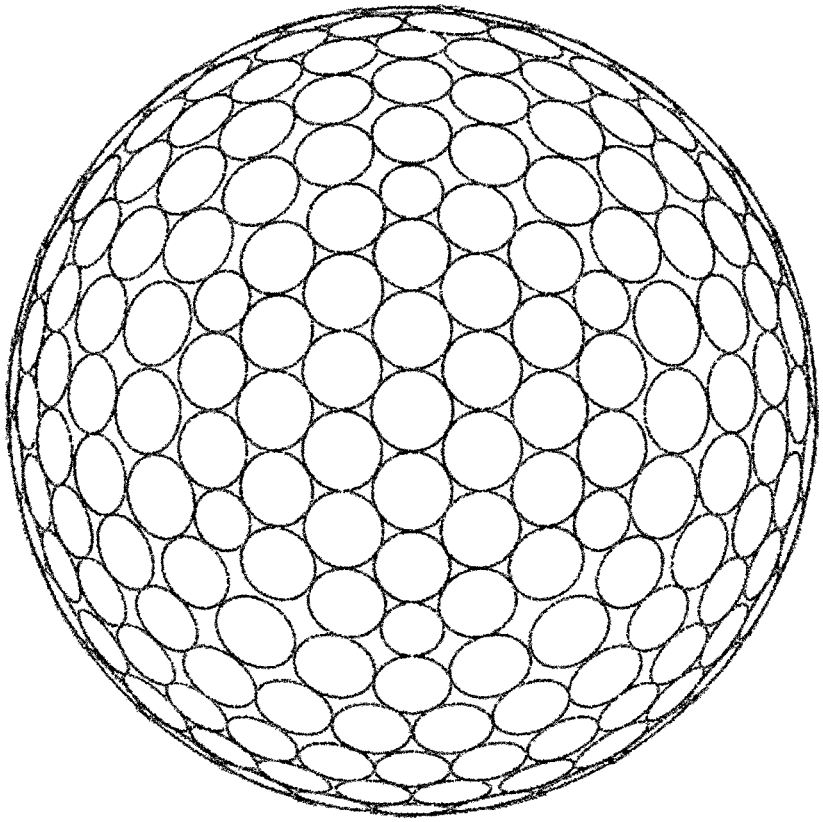
FIG. 50 is a plan view of the golf ball in FIG. 49.
Figure 51:
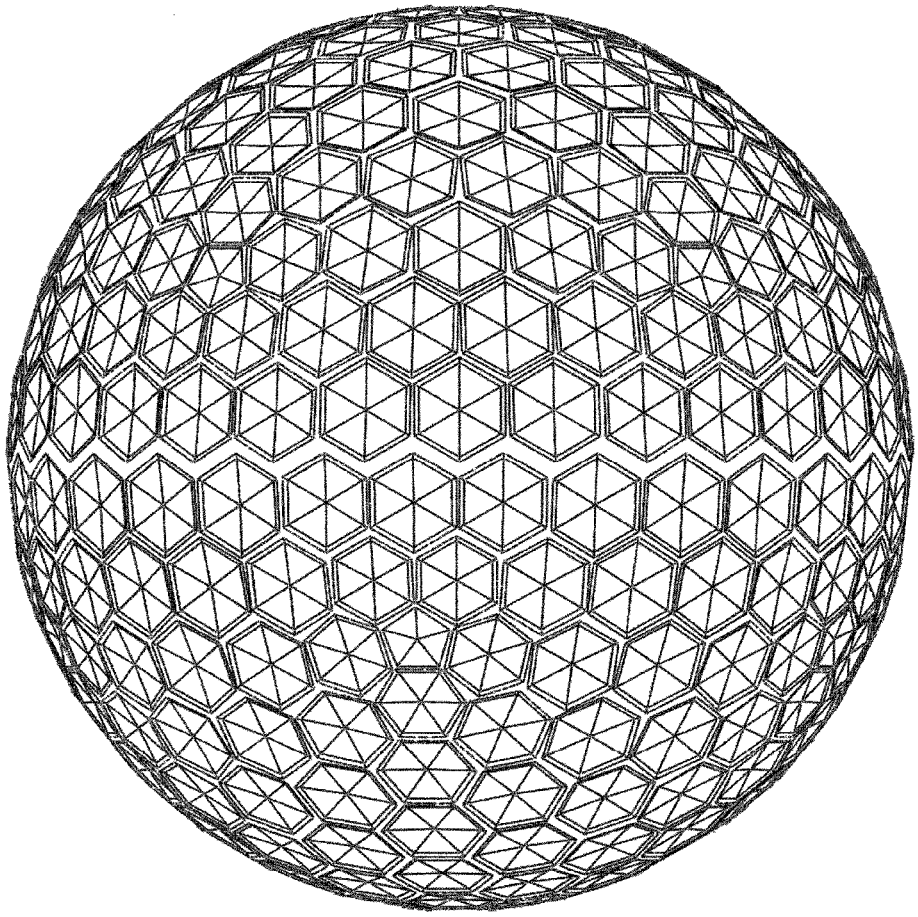
FIG. 51 is a front view of a golf ball according to Comparative Example 6.
Figure 52:
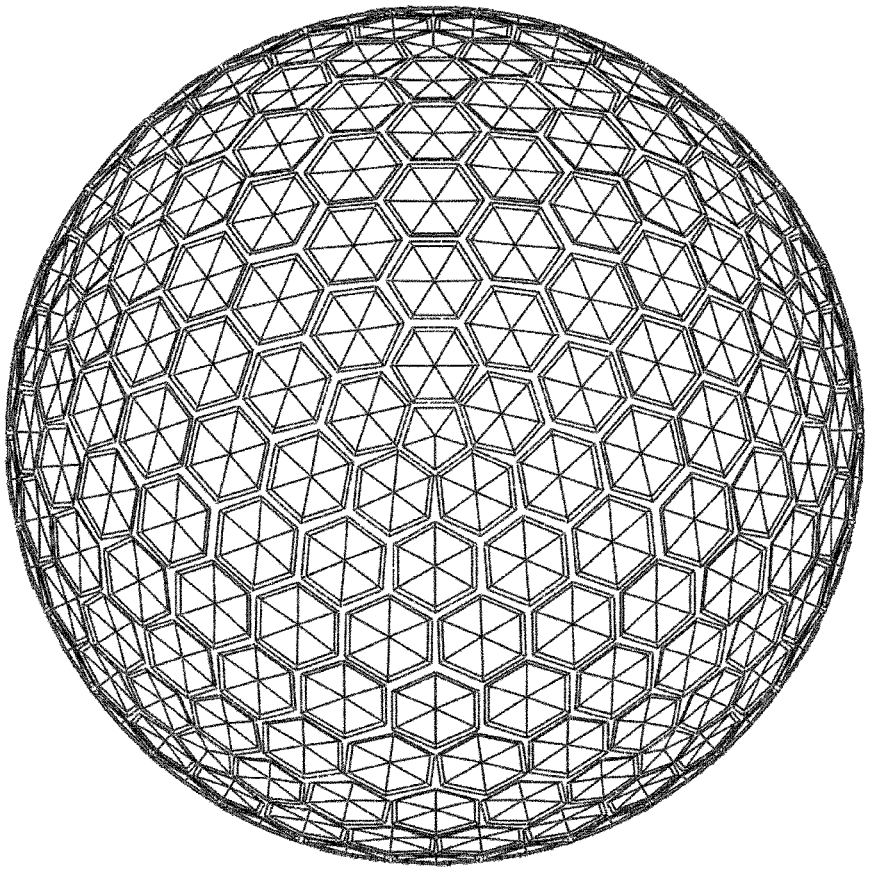
FIG. 52 is a plan view of the golf ball in FIG. 51.

| Results of Evaluation | | | |
|---|---|---|---|
| | Ex. 9 | Ex. 10 | Comp. Ex. 6 |
| Front view | FIG. 49 | FIG. 10 | FIG. 51 |
| Plan view | FIG. 50 | FIG. 11 | FIG. 52 |
| Number N of dimples | 344 | 344 | 332 |
| Shape | Circle | Voronoi | Polygon |
| Occupation ratio So | 0.840 | 0.920 | 0.860 |
| Standard deviation Su ($mm^2$) | 1.426 | 1.643 | 2.035 |
| Average area Sa ($mm^2$) | 13.99 | 15.32 | 14.84 |
| Formula (I) | Met | Met | Unmet |
| Formula (II) | Unmet | Met | Unmet |
| Formula (III) | Unmet | Met | Unmet |
| Formula (IV) | Unmet | Unmet | Unmet |
| Flight distance (m) | 258.7 | 262.7 | 254.0 |

As shown in Tables 3 to 6, the golf ball of each Example has excellent flight performance. From the results of evaluation, advantages of the present invention are clear.

The aforementioned dimples are applicable to golf ball having various structures such as a one-piece golf ball, a two-piece golf ball, a four-piece golf ball, a five-piece golf ball, a six-piece golf ball, a thread-wound golf ball, and the like in addition to a three-piece golf ball. The above descriptions are merely illustrative examples, and various modifications can be made without departing from the principles of the present invention.

What is claimed is:

1. A golf ball having a plurality of dimples on a surface thereof, wherein a ratio So of a sum of spherical surface areas of all the dimples to a surface area of a phantom sphere of the golf ball is equal to or greater than 0.780 and less than or equal to 0.95, at least one of the plurality of dimples has a spherical surface area differing from another one of the plurality of dimples, and the golf ball meets the following mathematical formula (I):

$$Su \leq 9.0*So-6.04 \quad \text{(I)},$$

where Su represents a standard deviation ($mm^2$) of the spherical surface areas of all the dimples.

2. The golf ball according to claim 1, wherein the ratio So is equal to or greater than 0.840.

3. The golf ball according to claim 1, wherein the standard deviation Su is equal to or less than 2.150 $mm^2$.

4. The golf ball according to claim 1, wherein the standard deviation Su is equal to or less than 1.946 $mm^2$.

5. The golf ball according to claim 1, wherein a number of the dimples is equal to or greater than 300 but equal to or less than 390.

6. The golf ball according to claim 1, wherein an average Sa of the spherical surface areas of all the dimples is equal to or greater than 14.00 $mm^2$.

7. The golf ball according to claim 1, wherein the golf ball has dimples whose contours are non-circular.

8. The golf ball according to claim 7, wherein each dimple has a contour shape different from those of any other dimples.

9. The golf ball according to claim 1, wherein the golf ball further meets the following mathematical formula (II):

$$Su \leq 9.0*So-6.25 \quad \text{(II)}.$$

10. The golf ball according to claim 1, wherein the golf ball further meets the following mathematical formula (III):

$$Su \leq 9.0*So-6.46 \quad \text{(III)}.$$

11. The golf ball according to claim 1, wherein the golf ball further meets the following mathematical formula (IV):

$$Su \leq 9.0*So-6.67 \quad \text{(IV)}.$$

12. The golf ball according to claim 1, wherein a number of types of dimples whose contour shapes are different from one another is equal to or greater than 50.

* * * * *